US007574148B2

(12) United States Patent
Igarashi et al.

(10) Patent No.: US 7,574,148 B2
(45) Date of Patent: Aug. 11, 2009

(54) IMAGE FORMING APPARATUS, DEVELOPER CARTRIDGE, AND DETECTING UNIT FOR DETECTING A STATE OF THE DEVELOPER CARTRIDGE

(75) Inventors: Hiroshi Igarashi, Nagoya (JP); Satoru Ishikawa, Kitanagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 62 days.

(21) Appl. No.: 11/565,174

(22) Filed: Nov. 30, 2006

(65) Prior Publication Data

US 2007/0122165 A1 May 31, 2007

(30) Foreign Application Priority Data

Nov. 30, 2005 (JP) ..... 2005-346129

(51) Int. Cl.
*G03G 15/00* (2006.01)

(52) U.S. Cl. ..... 399/12

(58) Field of Classification Search ..... 399/12, 399/13, 24, 262, 119
See application file for complete search history.

(56) References Cited

U.S. PATENT DOCUMENTS

| | | | | |
|---|---|---|---|---|
| 5,634,169 | A * | 5/1997 | Barry et al. | 399/12 |
| 5,995,772 | A * | 11/1999 | Barry et al. | 399/12 |
| 6,169,860 | B1 * | 1/2001 | Curry et al. | 399/12 |
| 6,298,202 | B1 * | 10/2001 | Fushiya et al. | 399/12 |
| 6,408,141 | B1 * | 6/2002 | Tahara | 399/12 |
| 6,483,995 | B2 * | 11/2002 | Iwaki et al. | 399/12 |
| 2001/0036368 | A1 * | 11/2001 | Curry et al. | 399/12 |
| 2005/0031359 | A1 * | 2/2005 | Ishii | 399/12 |
| 2006/0193644 | A1 * | 8/2006 | Takagi | 399/12 |

FOREIGN PATENT DOCUMENTS

| | | |
|---|---|---|
| JP | 11-174840 | 7/1999 |
| JP | 2001-092194 | 4/2001 |
| JP | 2001-188410 | 7/2001 |
| JP | 2003-195705 A | 7/2003 |
| JP | 2003-316227 | 11/2003 |

OTHER PUBLICATIONS

Computer translation of JP2003-316227A.*
CN Office Action dtd Jun. 6, 2008, CN App. 2006101667874.

* cited by examiner

*Primary Examiner*—Quana M Grainger
(74) *Attorney, Agent, or Firm*—Banner & Witcoff, Ltd.

(57) ABSTRACT

A light traveling permissible portion and a light traveling blocking portion are alternately disposed in a specification detecting and agitator driving gear such that a detection portion detects information corresponding to the maximum image formation sheet number. When the developer cartridge is new, a new/used cartridge detecting gear restricts transmission of the aforementioned information from the specification detecting and agitator driving gear to the detection portion for a predetermined time t, thereby detecting whether the developer cartridge is new or used. The detection portion detects whether the developer cartridge is mounted based on whether the detection light reflects from the light traveling permissible portion.

15 Claims, 10 Drawing Sheets

(a)

(b)

(c)

IMAGE FORMING APPARATUS, DEVELOPER CARTRIDGE, AND DETECTING UNIT FOR DETECTING A STATE OF THE DEVELOPER CARTRIDGE

CROSS REFERENCE TO RELATED APPLICATION

This application claims priority benefits on the basis of Japanese Patent Application No. 2005-346129 filed on Nov. 30, 2005, the disclosure of which is incorporated herein by reference.

BACKGROUND OF THE INVENTION

1. Field of the Invention

The present invention relates to an image forming apparatus (e.g., a laser printer) and to a developer cartridge removably mountable to the image forming apparatus.

2. Description of the Related Art

Conventionally known laser printer in which a developer cartridge is removably mountable containing a toner can detect whether or not the developer cartridge is mounted, and the mounted developer cartridge is new.

For example, a cartridge that is provided with a detecting means including an encoder for detecting the rotation speed of an agitation shaft in the toner cartridge, a transmission type photosensor, and a lever member which acts after a predetermined time when a new toner cartridge is mounted is proposed. The lever member is designed so that, after the rotation of the motor, when a pulse is not detected immediately but detected after a predetermined time from the transmission type photosensor, the mounted toner cartridge is detected as new. While the pulse is detected immediately after the rotation of the motor, the mounted toner cartridge is detected as used (see Japanese Unexamined Patent Publication No. 2003-316227).

SUMMARY OF THE INVENTION

The purpose of the present invention is to provide an image forming apparatus which is capable of detecting by a detection portion whether or not the developer cartridge is mounted to the image forming apparatus body, and whether the mounted developer cartridge is new or used, and further, the specification of the developer cartridge, and to provide a developer cartridge to be attachable to the image forming apparatus.

An object of the present invention is to provide an image forming apparatus comprising an image forming apparatus body, a developer cartridge attachable to and detachable from the image forming apparatus body, and a detecting unit for detecting whether or not the developer cartridge is attached to the image forming apparatus body, whether the developer cartridge attached to the image forming apparatus is new or used, and a specification of the developer cartridge attached to the image forming apparatus.

Another object of the present invention is to provide a developer cartridge attachable to and detachable from an image forming apparatus, comprising an accommodating chamber for accommodating developing agent, and a detected unit to be detected in the image forming apparatus whether or not the developer cartridge is attached to the image forming apparatus, whether the developer cartridge attached to the image forming apparatus is new or used, and a specification of the developer cartridge attached to the image forming apparatus.

BRIEF DESCRIPTION OF THE DRAWINGS

FIG. 7(*a*) illustrates a state with the developer cartridge not being mounted, FIG. 7(*b*) illustrates a state with the developer cartridge being mounted, FIG. 7(*c*) illustrates a new/used cartridge detecting gear being rotatively driven, and FIG. 7(*d*) illustrates the new/used cartridge detecting gear being not rotatively driven.

FIG. 9(*a*) illustrates a state with the developer cartridge mounted to the main body casing, and a leading abutment projection in abutment against an actuator, FIG. 9(*b*) illustrates a state in which the leading abutment projection passes over the actuator, FIG. 9(*c*) illustrates a state immediately before a rear abutment projection is in abutment against the actuator, FIG. 9(*d*) illustrates a state with the rear abutment projection in abutment against the actuator, and FIG. 9(*e*) illustrates a state in which the rear abutment projection passes over the actuator.

FIG. 10(*a*) illustrates a state with the developer cartridge mounted to the main body casing, and the abutment projection in abutment against an actuator, FIG. 10(*b*) illustrates a state in which the abutment projection passed over the actuator, and FIG. 10(*c*) illustrates a state immediately before the detection gear is stopped.

FIG. 11(*a*) illustrates a state with the abutment projection in abutment against an actuator, FIG. 11(*b*) illustrates a state when the abutment projection is passing over the actuator, and FIG. 11(*c*) illustrates a state with the abutment projection passed over the actuator.

DETAILED DESCRIPTION OF PREFERRED EMBODIMENTS

1. Overall Construction of Laser Printer

Figure 1:
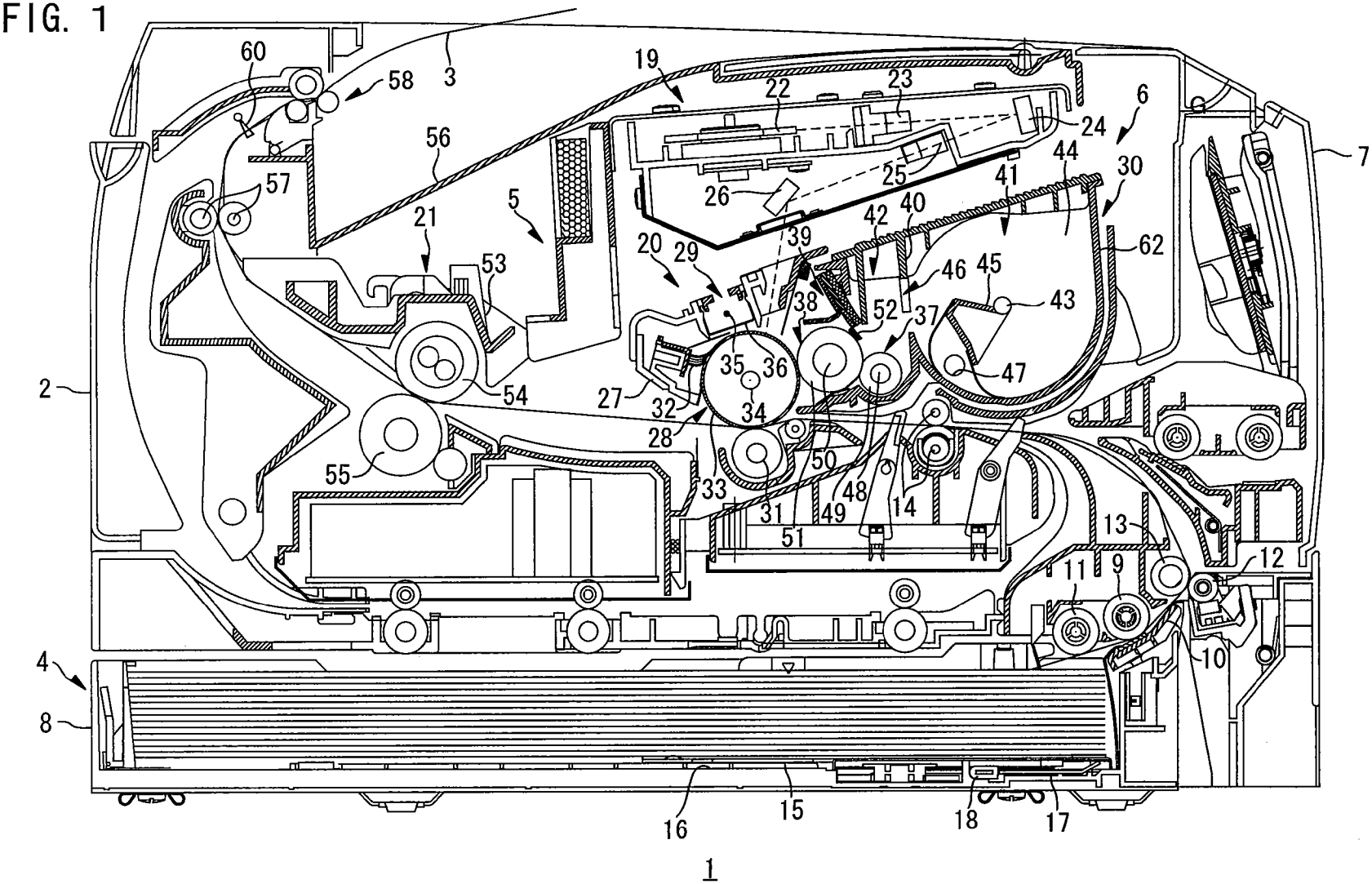
FIG. 1 is a side sectional view illustrating a major portion of a laser printer as an image forming apparatus according to the present invention.

FIG. 1 is a side sectional view illustrating a major portion of a laser printer as an image forming apparatus according to the present invention. This laser printer 1 comprises a main body casing 2 as an image forming apparatus body, and a feeder section 4 contained in the main body casing 2 for feeding a sheet 3 and an image forming section 5 for forming an image on the fed sheet 3.

(1) Main Body Casing

On one side wall of the main body casing 2, a mounting port 6 is formed for mounting and removing a process cartridge 20 and a front cover 7 is provided to open and close the mounting port 6. The front cover 7 is supported rotatably by the cover shaft (not shown) inserted on a lower edge thereof. When the front cover 7 is closed about the cover shaft, the front cover 7 closes the mounting port 6, as shown in FIG. 1, and when the front cover 7 is opened (or tilted) with the cover shaft as a fulcrum, the mounting port 6 is released. In this manner, the process cartridge 20 can be mounted and removed to and from the main body casing 2 via the mounting port 6.

In the following description, the "front" is used to define the side at which the front cover 7 is provided and the "rear" is used to define the opposite side in a state where the process cartridge 20 is mounted to the main body casing 2.

(2) Feeder Section

The feeder section 4 includes a sheet feeding tray 8 removably mounted along an anteroposterior direction and provided in a bottom portion of the main body casing 2, a separation roller 9 and a separation pad 10 provided above the front edge of the sheet feeding tray 8, and a sheet feeding roller 11 provided on the rear side of the separation roller 9 (the upstream side with respect to the separation pad 10 in a sheet conveying direction).

The feeder section 4 also includes a paper dust removing roller 12 provided above the front side of the separation roller 9 (the downstream side with respect to the separation roller 9 in the sheet conveying direction), and a pinch roller 13 provided in opposed relation with respect to the paper dust removing roller 12.

A sheet feeding transport path for feeding the sheet 3 is folded in generally U-shape from the vicinity of the paper dust removing roller 12 toward the rear side, and a registration roller 14 comprising a pair of rollers is provided in the downstream side in the sheet conveying direction and below the process cartridge 20.

In the sheet feeding tray 8, a sheet pressing plate 15 is provided to have the sheets 3 in stacked relation. The sheet pressing plate 15 is supported swingably about a rear edge thereof so as to be moved between a rest position at which the sheet pressing plate 15 fits on a bottom plate 16 of the sheet feeding tray 8 with a front edge thereof being located on a lower side and a sheet feeding position at which the sheet pressing plate 15 is tilted with the front edge thereof being located on an upper side.

A lever 17 which lifts the front edge of the sheet pressing plate 16 is provided at the front edge of the sheet feeding tray 9. The lever 17 has a rear edge supported swingably by the lever shaft 18 below the front edge of the sheet pressing plate 15 and has a front edge supported swingably between a lying position at which the front edge lies on the bottom plate 16 of the sheet feeding tray 8 and a tilting position at which the front edge lifts the sheet pressing plate 15.

When a driving force is inputted to the lever shaft 18, the lever 17 rotates about the lever shaft 18 and the front edge of the lever 17 lifts the front edge of the sheet pressing plate 15, moving the sheet pressing plate 15 into a sheet supplying position.

When the sheet pressing plate 15 is placed in the sheet supplying position, the sheet 3 on the sheet pressing plate 15 is pressed against the sheet feeding roller 11, and fed to a separation position between the separation roller 9 and the separation pad 10 by the rotation of the sheet feeding roller 11.

When the sheet feeding tray 8 is taken out from the main body casing 2, the sheet pressing plate 15 is located at the rest position since the front edge moves downward by its own weight. When the sheet pressing plate 15 is located at the rest position, the sheets 3 can be rested on the sheet pressing plate 15 in a stacked relation.

The sheet 3 fed to the separation position by the sheet feeding roller 11 is held between the separation roller 9 and the separation pad 10, and then is separated from the other sheets 3 and fed by the rotation of the separation roller 9.

The fed sheet 3 passes a place between the paper dust removing roller 12 and the pinch roller 13 and, after removal of paper dust in the place, is transported along the U-shaped sheet feeding transport path toward the registration rollers 14.

After registration, the registration rollers 14 transport the sheet 3 onto a transfer position which is between a photosensitive drum 28 and a transfer roller 31 and in which the toner image on the photosensitive drum 28 is transferred onto the sheet 3.

(3) Image Forming Section

An image forming section 5 includes a scanner section 19, a process cartridge 20, and a fixation section 21.

(a) Scanner Section

The scanner section 19 is provided in an upper portion of the main body casing 2. The scanner section 34 includes a laser beam source (not shown), a rotatively driven polygonal mirror 22, an f-θ lens 23, a reflector 24, a lens 25 and a reflector 26. In the scanner section 19, laser beams emitted from the laser beam source on the basis of image data are, as indicated by a chain line, deflected by the polygonal mirror 22, then passed through the f-θ lens 23 and reflected by the reflection mirror 24, and then passed through the lens 25 and refracted downward by the reflection mirror 26, thereby irradiated on the surface of the photosensitive drums 28 of the process cartridge 20.

(b) Process Cartridge

The process cartridge 20 is disposed below the scanner section 19 in the main body casing 2, and removably mounted with respect to the main body casing 2.

The process cartridge 20 includes a process frame 27, and a photosensitive drum 28, a scorotron charger 29, a developer cartridge 30, a transfer roller 31 and a cleaning brush 32 provided in the process frame 27.

The photosensitive drum 28 includes a drum body 33 having a cylindrical shape and a positively chargeable photosensitive layer of polycarbonate or the like provided as the outermost surface layer, and a metal drum shaft 34 extending in a longitudinal direction along the drum body 33 at the shaft center of the drum body 33.

The drum shaft 34 is supported by the process frame 27, and the drum body 33 is rotatably supported with respect to the drum shaft 34, thereby the photosensitive drum 28 is provided rotatably about the drum shaft 34 in the process frame 27.

Figure 2:
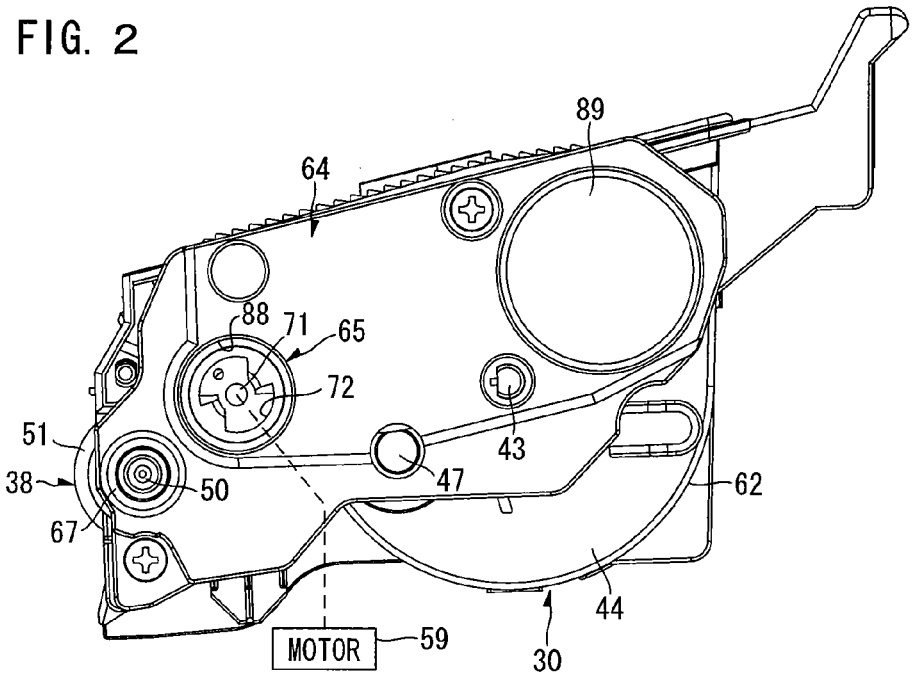
FIG. 2 is a side view illustrating a developer cartridge (with a gear cover being mounted) according to a first embodiment.

The photosensitive drum 28 is rotatively driven by the driving force inputted from a motor 59 (see FIG. 2)

The scorotron charger 29 is supported by the process frame 27 obliquely rearward above the photosensitive drum 28, and disposed in opposed spaced relation from the photosensitive drum 28 so as not to be brought into contact with the photosensitive drum 28.

The scorotron charger 29 includes an electric discharge wire 35 disposed in opposed spaced relation from the photosensitive drum 28, and a grid 36 provided between the electric discharge wire 35 and the photosensitive drum 28 for controlling the amount of electricity discharged from the electric discharge wire 35 to the photosensitive drum 28.

In the scorotron charger 29, a bias voltage is applied to the grid 36 and at the same time a high voltage is applied to the electric discharge wire 35 to cause the electric discharge wire 35 to generate corona discharge, thereby uniformly positively charging the surface of the photosensitive drum 28.

The developer cartridge 30 includes a housing 62, and a supply roller 37, a developer roller 38 and a layer-thickness regulating blade 39 provided in the housing 62.

The developer cartridge 30 is removably mounted to the process frame 27. Therefore, the developer cartridge 30 can also be mounted and removed to and from the main body casing 2 by being mounted and removed to and from the process cartridge 20 from the mounting port 6 by opening and closing the front cover 7 in a state where the process cartridge 20 is mounted in the main body casing 2.

The housing 62 has a box shape opened in the front and rear direction and contains opposite side walls 44 that are disposed in laterally opposed spaced relation (perpendicular to the anteroposterior direction and the top and bottom direction (vertical direction)). In the middle portion of the anteroposterior direction, a partition plate 40 is provided so as to partition the inner portion of the housing 62.

The front side of the housing 62 is partitioned by the partition plate 40 as a toner accommodation chamber 41 that contains the toner. The rear side of the housing 62 is partitioned by the partition plate 40 as a developing chamber 42 provided with a supply roller 37, a developer roller 38, and the layer-thickness regulating blade 39.

In the toner accommodation chamber 41, positively chargeable non-magnetic single-component toner is contained as a developing agent. As the toner, a polymerized toner is generally used. For preparation of the polymerized toner, polymerizable monomer, for example, styrenic monomer such as styrene and an acrylic monomer such as acrylic acid, an alkyl (C1 to C4) acrylate or an alkyl (C1 to C4) methacrylate is copolymerized using a method such as suspension polymerization. The polymerized toner is generally spherical particles. With excellent fluidity, the toner achieves high-quality image formation.

In such toner, colorant such as carbon black, wax and the like are contained, and further, external additive is added for improvement of the fluidity of the toner. The average particle diameter of the toner is approximately 6 to 10 μm.

The toner accommodation chamber 41 is provided with an agitator rotating shaft 43 at the center thereof. The agitator rotating shaft 43 is rotatably supported on the opposite side walls 44 of the housing 62. The agitator rotating shaft 43 is also provided with an agitator 45.

The agitator 45 is rotated by a driving force inputted from the motor 59 (see FIG. 2) to the agitator rotating shaft 43. When the agitator 45 is rotated, the toner in the toner accommodation chamber 41 is agitated and released from an opening 46 which communicates in an anteroposterior direction at the lower portion of the partition plate 40 toward the developing chamber 42.

Toner detecting windows 47 are provided at a position corresponding to the toner containing chamber 41 on the opposite side walls 44 in the housing 62 for detecting the amount of the toner remaining in the toner containing chamber 41.

The toner detecting windows 47 are disposed in laterally opposed spaced relation and sandwich the toner accommodation chamber 41. The main body casing 2 has on the outside of the one toner detecting window 47 a light emitting element (not shown) and has on the outside of the other toner detecting window 47 a light receiving element (not shown). The light receiving element detects a detection light which is emitted from the light emitting element, entered through the one toner detecting window 47 into the toner accommodation chamber 41, and then emitted from the toner accommodation chamber 41 through the other toner detecting window 47. Thus, according to the frequency of the detection light detected by the light receiving element, the laser printer 1 judges the remaining amount of the toner.

The supply roller 37 is located at the rear side of the opening 46. The supply roller 37 includes a metal supply roller shaft 48 and a sponge roller 49 of electrically conductive foamed materials to cover the supply roller shaft 48.

The supply roller shaft 48 is rotatably supported at a position that corresponds to the developing chamber 42 on the opposite side walls 44 in the housing 62. The supply roller 37 is rotatively driven by the driving force inputted to the supply roller shaft 48 from the motor 59 (see FIG. 2).

The developer roller 38 is disposed at the rear side of the supply roller 37 and brought into press contact with the supply roller 37. The developer roller 38 includes a metal developer roller shaft 50 and a rubber roller 51 of electrically-conductive rubber materials to coat the developer roller shaft 50.

The developer roller shaft 50 is rotatably supported at a position that corresponds to the developing chamber 42 on the opposite side walls 44 in the housing 62. The rubber roller 51 is formed of electrically-conductive urethane rubber or silicone rubber containing carbon particles, and is coated by a coating layer of urethane rubber or silicone rubber containing fluorine on the surface thereof.

The developer roller 38 is rotatively driven by a driving force inputted from the motor 59 (see FIG. 2) to the developer roller shaft 50. The developer roller 38 is applied with a developing bias during development.

The layer-thickness regulating blade 39 includes a blade body comprising a metal leaf spring member, and a press member 52 of an electrically insulative silicone rubber having a semicircular cross sectional shape and provided on a free end edge of the blade body. A proximal edge of the blade body of the layer-thickness regulating blade 39 is fixed to the housing 62 above the developer roller 38. Thus, the press member 52 is pressed against the developer roller 38 by the elastic force of the blade body.

The toner released from the opening 46 is supplied to the developer roller 38 by the rotation of the supply roller 37, and, at this time, is triboelectrically positively charged between the supply roller 37 and the developer roller 38. The toner supplied to the developer roller 38 is introduced between the press member 52 of the layer-thickness regulating blade 39 and the rubber roller 51 of the developer roller 38 by the rotation of the developer roller 38, whereby the toner is carried in the form of a thin film having a uniform thickness on the surface of the developer roller 38.

The transfer roller 31 is rotatably supported on the process frame 27 and disposed below the photosensitive drum 28 so as to be disposed in vertically opposed relation and in contact with the photosensitive drum 28, thereby forming a nip between the transfer roller 31 and the photosensitive drum 28.

The transfer roller 31 has a metal roller shaft, and a rubber roller of electrically-conductive rubber materials to coat the roller shaft. A transfer bias is applied to the transfer roller 31 during transfer. The transfer roller 31 is rotatively driven by the driving force inputted from the motor 59 (see FIG. 2).

The cleaning brush 32 is mounted in the process frame 27 so as to be disposed in opposed relation and in contact with the photosensitive drum 28 at the rear side of the photosensitive drum 28.

The surface of the photosensitive drum 28, after being uniformly positively charged by the scorotron charger 29, with the rotation of the photosensitive drum 28, is exposed to the laser beams scanned at a high speed by the scanner section 19, whereby an electrostatic latent image corresponding to an image to be formed on the sheet 3 is formed on the surface of the photosensitive drum 28.

Then, as the developer roller 38 is rotated, the toner positively charged and carried on the surface of the developer roller 38 is brought into contact with the photosensitive drum 28. At this time, the toner is supplied to the electrostatic latent image formed on the surface of the photosensitive drum 28, i.e., to an exposed part of the surface of the uniformly positively charged photosensitive drum 28 having an electrical potential reduced by the exposure with the laser beams. Thus, the electrostatic latent image on the photosensitive drum 28 is developed into a visible form, whereby a toner image is carried on the surface of the photosensitive drum 28 by reversion.

Then, while the sheet 3 transported by the registration rollers 14 passes through the transfer position between the photosensitive drum 28 and the transfer roller 31, the toner image carried on the surface of the photosensitive drum 28 is transferred to the sheet 3 by the transfer bias applied to the transfer roller 31. The sheet 3 on which the toner image is transferred is then transported to the fixation section 21.

The toner remaining on the photosensitive drum 28 after the transfer is recovered by the developer roller 38. Paper dust generated from the sheet 3 and adhering to the photosensitive drum 28 after the transfer is removed by the cleaning brush 32.

(c) Fixation Section

The fixation section 21 is provided at the rear side of the process cartridge 20 and includes a fixation frame 53, and a heating roller 54 and a pressing roller 55 provided in the fixation frame 53.

The heating roller 54 has a metal tube with the surface thereof coated by fluorine resins and a halogen lamp inserted in the metal tube for heating. The heating roller 54 is rotatively driven by the driving force inputted from the motor 59 (see FIG. 2).

The pressing roller 55 is disposed in opposed relation below the heating roller 54 so as to press the heating roller 54. The pressing roller 55 has a metal roller shaft and a rubber roller of rubber material to coat the roller shaft. The pressing roller 55 is driven by the rotative driving of the heating roller 54.

In the fixation section 21, the toner image transferred on the sheet 3 at the transfer position is thermally fixed on the sheet 3 while the sheet 3 is passed between the heating roller 54 and the pressing roller 55. The sheet 3 fixed with the toner image is transported to a sheet ejection tray 56 formed on the upper surface of the main body casing 2.

The sheet ejection transport path for the sheet 3, starting from the fixation section 21 to the sheet ejection tray 56, is folded in generally U-shape from the fixation section 21 to front side, and is provided with a transport roller 57 at a point on the path and a sheet ejection roller 58 at the lower end of the downstream, respectively.

The sheet 3 thermally fixed in the fixation section 21 is transported to the sheet ejection transport path, and transported to the sheet ejection roller 58 by the transport roller 57, and then ejected onto the sheet ejection tray 56 by the sheet ejection rollers 58.

A sheet ejection sensor 60 is provided between the transport roller 57 and the sheet ejection roller 58 on the sheet ejection transport path. Every time when the sheet transported through the sheet ejection transport path passes over, the sheet ejection sensor 60 swings. Each swing is counted by a CPU 90 (see FIG. 3) provided in the main body casing 2, and the number counted is stored in a memory unit (not shown) as an actual image formation sheet number.

In the laser printer 1, as later described, the CPU 90 (see FIG. 3) detects whether or not the developer cartridge 30 is mounted in the main body casing 2, and whether the developer cartridge 30 mounted in the main body casing 2 is new or used. In the case where the developer cartridge 30 is new, the CPU 90 detects the maximum image formation sheet number of the developer cartridge 30 as a specification thereof. Accordingly, the number of sheets actually used for the image formation from a time when the new developer cartridge 30 is mounted and the maximum image formation sheet number (described later) of the mounted developer cartridge 30 are compared, and immediately before the point when the number of sheets actually used for the image formation exceeds the maximum image formation sheet number (described later), a "toner empty" warning message is displayed on a operation panel (not shown).

2. Detection Mechanism of Developer Cartridge According to First Embodiment

Figure 3:
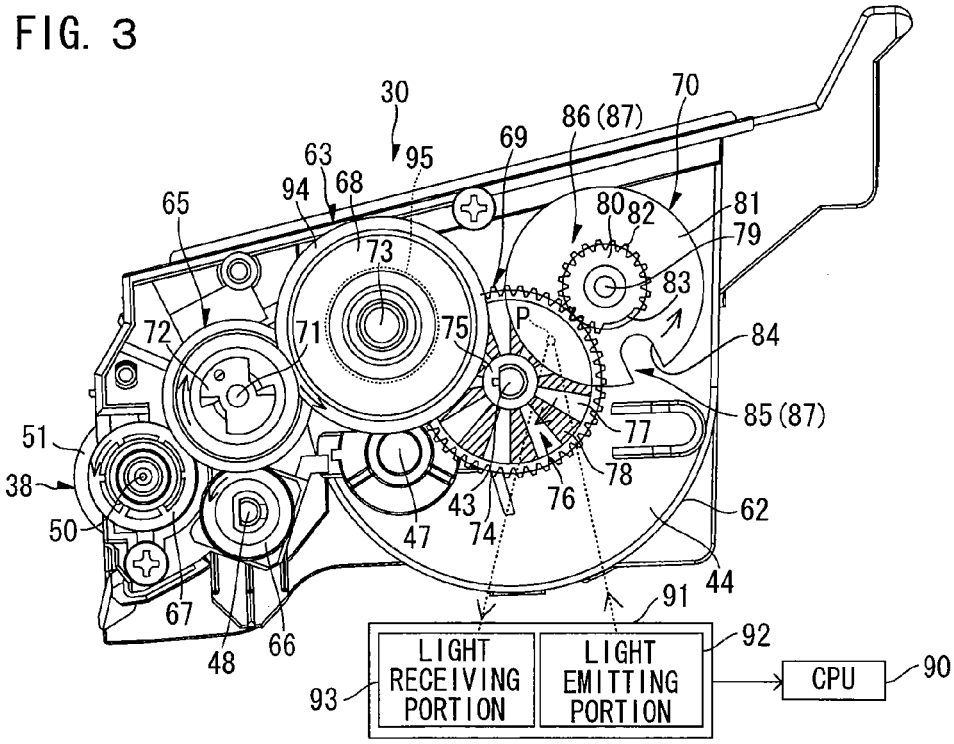
FIG. 3 is a side view illustrating the developer cartridge (with the gear cover being detached and a new/used cartridge detecting gear before being rotated) according to the first embodiment.
Figure 4:
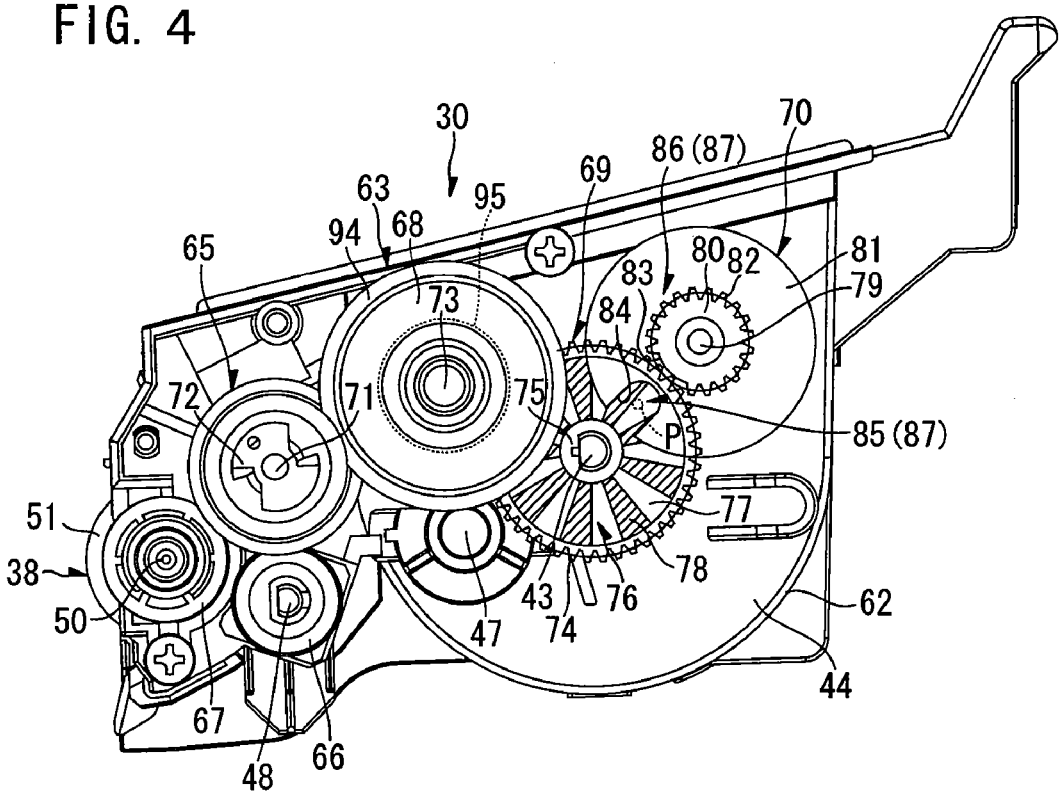
FIG. 4 is a side view illustrating the developer cartridge (with the gear cover being detached and the new/used cartridge detecting gear after being stopped after rotation) according to the first embodiment.
Figure 5:
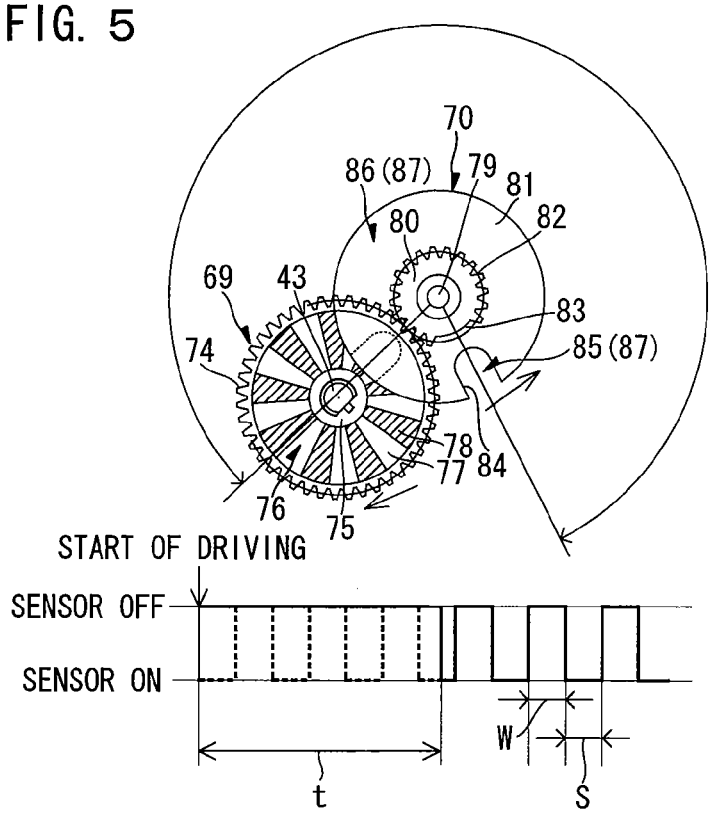
FIG. 5 is a view illustrating a relationship between a rotational operation and a detection pulse of a specification detecting and agitator driving gear (maximum image formation sheet number: 6000).
Figure 6:
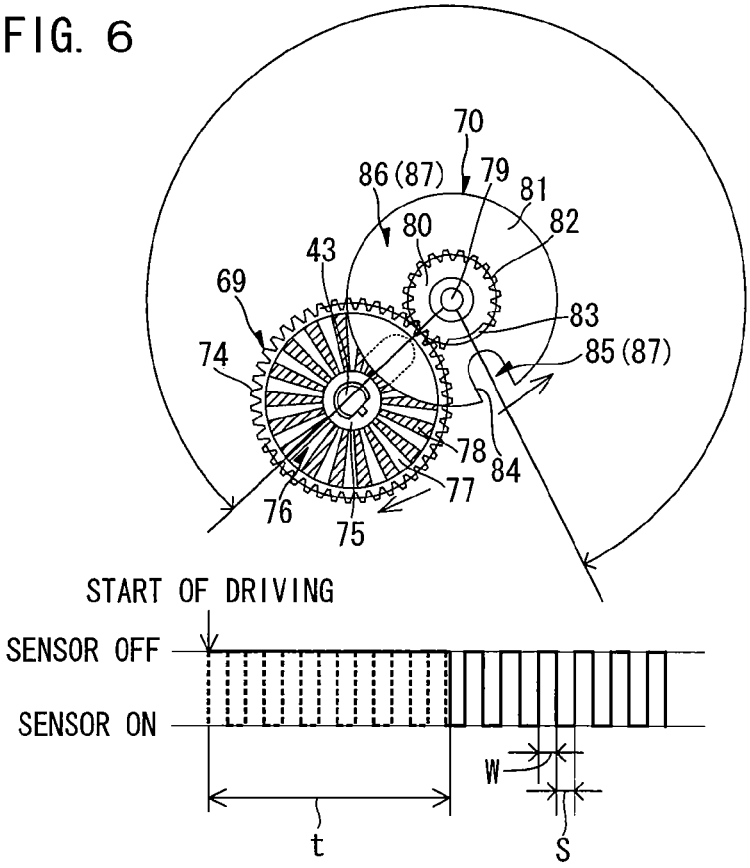
FIG. 6 is a view illustrating a relation between a rotational operation and a detection pulse of a specification detecting and agitator driving gear (maximum image formation sheet number: 3000).

FIG. 2 is a side view illustrating a developer cartridge (with a gear cover being mounted) according to a first embodiment, FIG. 3 is a side view illustrating the developer cartridge (with the gear cover being detached and a new/used cartridge detecting gear before being rotated) according to the first embodiment, FIG. 4 is a side view illustrating the developer cartridge (with the gear cover being detached and the new/used cartridge detecting gear after being stopped after rotation) according to the first embodiment, FIG. 5 is a view illustrating a relationship between a rotational operation and a detection pulse of a specification detecting and agitator driving gear (maximum image formation sheet number: 6000), and FIG. 6 is a view illustrating a relationship between a rotational operation and a detection pulse of a specification detecting and agitator driving gear (maximum image formation sheet number: 3000).

The first embodiment of the detection mechanism will hereinafter be described with reference to FIG. 2 through FIG. 6. The detection mechanism detects whether or not the developer cartridge 30 is mounted in the main body casing 2, and whether the developer cartridge 30 mounted in the main body casing 2 is new or used. In the case where the developer cartridge 30 is new, the detection mechanism detects the maximum image formation sheet number of the new developer cartridge 30.

(a) Construction of Developer Cartridge

In FIGS. 2 and 3, the developer cartridge 30 is provided with a gear mechanism 63 for rotatably driving the agitator rotating shaft 43 of the agitator 45, the supply roller shaft 48 of the supply roller 37, and the developer roller shaft 50 of the developer roller 38 respectively, as shown in FIG. 3, and a gear cover 64 for covering the gear mechanism 63 as shown in FIG. 2.

As shown in FIG. 3, the gear mechanism 63 is provided on one side wall 44 in the housing 62 of the developer cartridge 30. The gear mechanism 63 includes an input gear 65, a supply roller driving gear 66, a developer roller driving gear 67, an intermediate gear 68, a specification detecting and agitator driving gear 69 which is a first gear as a detected unit and information providing unit, and a new/used cartridge detecting gear 70 which is a second gear as a detected unit and for controlling information conveyance.

The input gear 65 is rotatably supported by the input gear support shaft 71 projecting laterally outward from the one side wall 44 between the developer roller shaft 50 and the agitator rotating shaft 43.

The shaft center of the input gear 65 is provided with a coupling receiving portion 72, to which the driving force generated by the motor 59 as a driving source in the main body casing 2 is inputted when the developer cartridge 30 is mounted to the main body casing 2.

The supply roller driving gear 66 is provided at the shaft end portion of the supply roller shaft 48 in a manner rotatable together with the shaft end portion in mesh-engagement with the input gear 65 on the lower side of the input gear 65.

The developer roller driving gear 67 is provided at the shaft end portion of the developer roller shaft 50 in a manner rotatable together with the shaft end portion in mesh-engagement with the input gear 65 on the obliquely rear lower side of the input gear 65.

The intermediate gear 68 is rotatably supported by an intermediate gear support shaft 73 projecting laterally outward from the one side wall 44 on the front side of the input gear 65. The intermediate gear 68 is a two-step gear integrally comprising outer teeth 94 meshed with the input gear 65 and inner teeth 95 meshed with the specification detecting and agitator driving gear 69.

The specification detecting and agitator driving gear 69 is provided at a shaft end portion of the agitator rotating shaft 43 in a manner rotatable together with the shaft end portion on the obliquely front lower side of the intermediate gear 68.

The specification detecting and agitator driving gear 69 integrally comprises gear teeth 74 provided on the outer peripheral surface thereof, a shaft portion 75 at the center of the rotation, and a first information portion 76 between the gear teeth 74 and the shaft portion 75.

The gear teeth 74 is provided along the entire circumference of the specification detecting and agitator driving gear 69 at the outer peripheral surface thereof and meshed with the inner teeth 95 of the intermediate gear 68 and the new/used cartridge detecting gear 70.

The shaft portion 75 has a cylindrical shape, and is provided at the rotation center of the specification detecting and agitator driving gear 69. The shaft portion 75 has the agitator rotating shaft 43 inserted therethrough in a relatively unrotatable manner.

The first information portion 76 has a light traveling permissible section 77 for permitting the traveling of the detection light and a light traveling blocking section 78 for blocking the traveling of the detection light.

The light traveling permissible section 77 has a light-reflective surface such as white colored surface, which can reflect the detection light emitted from a light emitting portion 92 of a detection portion 91 to be later described. The detection light reflected at the light traveling permissible section 77 is detected at a light receiving portion 93 in a detection portion 91 to be later described, and the detection signal of detection light (sensor-on-signal) is inputted to the CPU 90 as first information detected by the detection portion 91.

The light traveling blocking section 78 has a light absorption surface such as black colored surface, which does not reflect but absorbs the detection light emitted from the light emitting portion 92 of the detection portion 91 to be described later. When the detection light is absorbed at the light traveling blocking section 78, the light receiving portion 93 of the detection portion 91 to be later described does not detect the detection light. The non-detection signal of detection light (sensor-off-signal) is inputted to the CPU 90 as second information that is not detected by the detection portion 91.

In the first information portion 76, the light traveling permissible portions 77 and the light traveling blocking portions 78 are alternately disposed at an annular ring portion between the gear teeth 74 and the shaft portion 75 in the specification detecting and agitator driving gear 69 for providing information corresponding to the maximum image formation sheet number of the developer cartridge 30 to the detection portion 91.

The maximum image formation sheet number of the developer cartridge 30 is defined as a maximum number of sheet 3 on which forming image by the toner accommodated in the toner accommodation chamber 41 can be performed when the developer cartridge 30 is new.

More specifically, the light traveling permissible portions 77 and the light traveling blocking portions 78 are alternately disposed radially from the shaft portion 75 toward the gear teeth 74 at the aforementioned annular ring portion. Each of the light traveling permissible portions 77 and the light traveling blocking portions 78 are provided as streaks gradually wider from the shaft portion 75 to the gear teeth 74 as seen from side view.

The alternative arrangement (the width and the number) of the light traveling permissible portions 77 and the light traveling blocking portions 78 corresponds to the maximum image formation sheet number of the developer cartridge 30. For example, in the case where the maximum image formation sheet number of the developer cartridge 30 is 6000, the smaller number (nine) of streaks of the light traveling permissible portions 77 and the light traveling blocking portions 78 each having a greater width are provided as shown in FIG. 5.

On the other hand, in the case where the maximum image formation sheet number of the developer cartridge 30 is 3000, the larger number (17) of streaks of the light traveling permissible portions 77 and the light traveling blocking portions 78 each having a narrower width are provided as shown in FIG. 6.

Thus, when the specification detecting and agitator driving gear 69 is rotated as described later, for example in the case of the first information portion 76 as shown in FIG. 5, the CPU 90 detects a waveform having greater pulse width W and pulse interval S by the sensor-on-signal and the sensor-off-signal inputted from the detection portion 91. On the other hand, in the case of the first information portion 76 as shown in FIG. 6, the CPU 90 detects a waveform having narrower pulse width W and pulse interval S by the sensor-on-signal and the sensor-off-signal inputted from the detection portion 91.

As shown in FIG. 3, the new/used cartridge detecting gear 70 is rotatably supported by the new/used cartridge detecting gear support shaft 79 projecting laterally outward from the one side wall 44 in an obliquely upper portion on the front side of the specification detecting and agitator driving gear 69.

The new/used cartridge detecting gear 70 integrally comprises a gear portion 80 and a flange portion 81 that has a greater diameter than the gear 80.

The gear portion 80 is provided with gear teeth 82 and a non-toothed portion 83 at the outer peripheral surface thereof.

The gear teeth 82 are provided along the entire outer peripheral surface of the gear portion 80 except the non-toothed portion 83, and meshed with gear teeth 74 of the specification detecting and agitator driving gear 69.

The non-toothed portion 83 is provided on the outer peripheral surface of the gear portion 80 where the gear teeth 82 are not provided. When the non-toothed portion 83 is disposed in opposing relation to the gear teeth 74 of the specification detecting and agitator driving gear 69, the meshed relation between the specification detecting and agitator driving gear 69 and the new/used cartridge detecting gear 70 is released.

The non-toothed portion 83 on the outer peripheral surface of the gear portion 80 is disposed in opposed relation with the gear teeth 74 of the specification detecting and agitator driving gear 69 when a passage portion 85 to be described next is overlapped with the detection light passage.

The gear portion 80 is provided in such a way as shown in FIG. 3 that the upstream end in the rotational direction of the gear portion 80 of the gear teeth 82 meshes with the gear teeth 74 of the specification detecting and agitator driving gear 69 when the developer cartridge 30 is new.

The flange portion 81 is disposed laterally inward to the gear portion 80 and formed in a disk shape extending radially outward from the gear portion 80. The flange portion 81 has a cut away portion 84 for allowing the detection light later described to pass therethrough. The cut away portion 84 is formed by cutting away in generally U-shape as seen from side view from the outer peripheral surface toward the radially inner side of the flange portion 81. Accordingly, the flange portion 81 is provided with a second information portion 87 which has a light passage portion 85 as an opening portion formed by the cut away portion 84 for allowing the detection light to pass therethrough and a light blocking portion 86 which is a portion other than the light passage portion 85 for blocking the passage of the detection light.

In the new/used cartridge detecting gear 70, the gear portion 80 is rotatably supported by the new/used cartridge detecting gear support shaft 79. The flange portion 81 is disposed in such a way that the flange portion 81 overlaps laterally outward with the specification detecting and agitator driving gear 69 at an irradiating position P of the detection light in the first information portion 76.

With this arrangement, the new/used cartridge detecting gear 70 is disposed at the detection light passage so as to be partially overlapped with the specification detecting and the agitator driving gear 69. As described later, when the new/used cartridge detecting gear 70 is rotatably driven, the aforementioned irradiating position P of the first information portion 76 in the specification detecting and the agitator driving gear 69 and the light blocking portion 86 of the new/used cartridge detecting gear 70 are overlapped laterally for a predetermined time t (see FIG. 5). During this time, the detection light is blocked by the light blocking portion 86 so that the detection light cannot be reached at the irradiating position of the first information portion 76. At the end of the predetermined time t (see FIG. 5), the aforementioned irradiating position P of the first information portion 76 in the specification detection and the agitator driving gear 69 and the light transmission portion 85 of the new/used cartridge detecting gear 70 are laterally overlapped, the detection light is allowed to pass through the light passage portion 85 and is reached at the irradiating position P of the first information portion 76.

As shown in FIG. 2, the gear cover 64 is mounted on the one side wall 44 of the developer cartridge 30 to cover the gear mechanism 63. The gear cover 64 is provided with a rear opening 88 for exposing the coupling receiving portion 72 at the rear side thereof, and a new/used cartridge detecting gear cover portion 89 for covering the new/used cartridge detecting gear 70 at the front side thereof.

The new/used cartridge detecting gear cover portion 89 is bulged laterally outward so as to be able to accommodate the new/used cartridge detecting gear 70.

(b) Construction of Main Body Casing

As shown in FIG. 3, the main body casing 2 includes the CPU 90 as a detecting unit for detecting whether or not the developer cartridge 30 is mounted in the main body casing 2, and whether the mounted developer cartridge 30 is new or used, and in the case where the developer cartridge 30 is new, the maximum image formation sheet number of the developer cartridge 30 as a specification thereof, and a detection portion 91 connected to the CPU 90.

The detection portion 91 is provided so as to oppose laterally to the developer cartridge 30 mounted on the main body casing 2 on the inner surface of the one side wall of the main body casing 2. The detection portion 91 comprises a reflection optical sensor and includes a light emitting portion 92 having a light emitting element and a light receiving portion 93 having a light receiving element.

The light emitting portion 92 is disposed so as to irradiate the detection light toward the aforementioned irradiating position P of the first information portion 76 of the specification detecting and agitator driving gear 69 on the inner surface of the one side wall with the developer cartridge 30 being mounted. The light receiving portion 93 is disposed in parallel relation with the light emitting portion 92 so as to receive the detection light reflected at the aforementioned irradiating position P on the inner surface of the one side wall.

Further, the main body casing 2 is provided with the motor 59 that inputs the driving force to the coupling receiving portion 72 of the input gear 65. (See FIG. 2)

3. Operation of Detection Mechanism of Developer Cartridge According to First Embodiment Next, a method for detecting whether or not the developer cartridge 30 is mounted, whether or not the developer cartridge 30 is new, and the maximum image formation sheet number of the developer cartridge 30 with the developer cartridge 30 being mounted in the main body casing 2 is described.

First, the front cover 7 is opened and the process cartridge 20 mounted with the new developer cartridge 30 is mounted from the mounting port 6 to the main body casing 2. Alternatively, the front cover 7 is opened and the new developer cartridge 30 is mounted from the mounting port 6 to the process cartridge 20 that is mounted in the main body casing 2.

When the developer cartridge 30 is mounted in the main body casing 2, a coupling insertion portion (not shown) is inserted in the coupling receiving portion 72 of the input gear 65 of the developer cartridge 30, and the driving force is transmitted to the coupling insertion portion from the motor 59 provided in the main body casing 2. This makes it possible to drive the input gear 63, the supply roller driving gear 66, the developer roller driving gear 67, the intermediate gear 68, the specification detecting and agitator driving gear 69 and the new/used cartridge detecting gear 70 of the gear mechanism 63.

Then, a warm-up operation is started to perform an initial turning operation to rotate the agitator 45 by the control of the CPU 90 in the laser printer 1.

A trigger for the starting of the initial turning operation is a detection signal of the power-on operation and the closing operation of the front cover 7. The detection signal is inputted to the CPU 90 as the trigger signal to start the initial turning operation.

In the initial turning operation, the motor 59 provided in the main body casing 2 is driven by the control of the CPU 90, and the driving force of the motor 59 is inputted from the coupling insertion portion to the input gear 65 via the coupling receiving portion 72 in the developer cartridge 30, whereby the input gear 65 is rotatively driven.

Then, the supply roller driving gear 66 meshed with the input gear 65 is rotatively driven, and as the supply roller shaft 48 is rotated, the supply roller 37 is also rotated. Further, the developer roller driving gear 67 meshed with the input gear 65 is rotatively driven, and as the developer roller shaft 50 is rotated, the developer roller 38 is also rotated.

Furthermore, as the outer teeth 94 of the intermediate gear 68 meshed with the input gear 65 are rotatively driven, the inner teeth 95 of the intermediate gear 68 formed integrally with the outer teeth 94 are rotatively driven. When the inner teeth 95 of the intermediate gear 68 are rotatively driven, the specification detecting and agitator driving gear 69 meshed with the inner teeth 95 of the intermediate gear 68 are rotatively driven, and as the agitator rotating shaft 43 rotates, the agitator 45 is rotated. As the agitator 45 rotates, the toner in the toner accommodation chamber 41 is agitated.

Further, when the specification detecting and agitator driving gear 69 is rotatively driven, the new/used cartridge detecting gear 70 meshed with the specification detecting and agitator driving gear 69 is rotatively driven only during a distance between the rotationally upstream end portion and the rotationally downstream end portion formed with the gear teeth 82 of the gear portion 80 (gear teeth 82 of the gear portion 80 meshed with the gear teeth 74 of the specification detecting and agitator driving gear 69).

That is, the new/used cartridge detecting gear 70 is rotatively driven only for a predetermined time t (see FIG. 5) when the gear teeth 74 of the new/used cartridge detecting gear 70 is meshed with the gear teeth 82 of the specification detecting and agitator driving gear 69. At the end of the predetermined time t (See FIG. 5), as shown in FIG. 4, the non-toothed portion 83 is opposed to the gear teeth 74 of the specification detecting and agitator driving gear 69 and the rotation is stopped. The new/used cartridge detecting gear 70 is kept in a stopped state because there is a frictional resistance between the gear 70 and the new/used cartridge detecting gear support shaft 79.

When the new/used cartridge detecting gear 70 is rotatably driven in such a manner, the light blocking portion 86 is continuously disposed at the detection light passage of the detection portion 91 from the time when the developer cartridge 30 is mounted, so that the detection light is continuously not detected at the light receiving portion 93.

This keeps a state in which a non-detection signal of detection light (sensor-off-signal) is inputted to the CPU 90 for a predetermined time t as measured from the start of the driving of the motor 59 (i.e., from the time when the trigger signal is inputted to the CPU 90) as shown in FIG. 5.

The CPU 90 judges that the developer cartridge 30 is new when a state is continued in which the non-detection signal of detection light (sensor-off-signal) is inputted to the CPU 90 for a predetermined time t as measured from the start of the driving of the motor 59, i.e., when sensor-off-signals are continuously transmitted for the predetermined time t as measured from the start of the driving of the motor.

Thereafter, when the non-toothed portion 83 of the new/used cartridge detecting gear 70 is opposed to the gear teeth 74 of the specification detecting and agitator driving gear 69 and the new/used cartridge detecting gear 70 is stopped, the light passage portion 85 of the new/used cartridge detecting gear 70, as shown in FIG. 4, are overlapped with the aforementioned irradiating position P of the first information portion 76 of the specification detecting and agitator driving gear 69.

Then, the detection light passing over the light passage portion 85 and emitted from the light emitting portion 92, after passing over the light transmission portion 85, reaches the irradiating position P of the first information portion 76. On the other hand, because the specification detecting and agitator driving gear 69 is rotatively driven by the driving force from the motor 59, the irradiating position P of the first information portion 76 has the light traveling permissible portions 77 and the light traveling blocking portions 78 alternately disposed.

As a result, when the light traveling permissible portions 77 are disposed at the irradiating position P of the first information portion 76, the detection light that passes over the light transmission portion 85 is reflected at the light traveling permissible portions 77 and again passes over the light passage portion 85 and is detected by the light receiving portion 93, whereby the detection signal of detection light(sensor-on-signal) is inputted from the detection portion 91 to the CPU 90 based on the detection by the light receiving portion 93.

On the other hand, when the light traveling blocking portions 78 is disposed at the irradiating position P of the first information portion 76, the detection light that passes over the light passage portion 85 is absorbed at the light traveling blocking section 78, whereby the light does not pass over again the light transmission portion 85 and is not detected by the light receiving portion 93, thereby inputting the non-detection signal of detection light (sensor-off-signal) from the detection portion 91 to the CPU 90 based on the non-detection by the light receiving portion 93.

Therefore, in the CPU 90, when the developer cartridge 30 is new, the sensor-off-signal is input for a predetermined time t as measured from the start of the driving of the motor 59, and then on the basis of the alternate disposition of the light traveling permissible portions 77 and the light traveling blocking portions 78 corresponding to the maximum image formation sheet number of the developer cartridge 30, the sensor-on-signal and the sensor-off-signal are alternately inputted.

The CPU 90 detects the maximum image formation sheet number of the mounted developer cartridge 30 by the length of the pulse width W and the pulse interval S on the basis of the sensor-on-signal and the sensor-off-signal.

That is, a ROM (not shown) connected to the CPU 90 stores a table about the maximum image formation sheet numbers corresponding to the length of the pulse width W and the pulse interval S on the basis of the sensor-on-signal and the sensor-off-signal. For example, corresponding to a long waveform of the pulse width W and the pulse interval S, the ROM stores that the maximum image formation sheet number is 6000, and corresponding to a short waveform of the pulse width W and the pulse interval S, the ROM stores that the maximum image formation sheet number is 3000.

When the first information portion 76 shown in FIG. 5 is provided at the specification detecting and agitator driving gear 69 in the attached new developer cartridge 30, for example, the CPU 90 detects a long waveform in the pulse width and the pulse interval and thus judges that the maximum image sheet number of the developer cartridge 30 is 6000.

The laser printer 1 thus displays a "toner empty" warning message on the operation panel (not shown) or the like immediately before the number of image formation sheets actually detected by the sheet ejection sensor 60 exceeds 6000 after the new developer cartridge 30 is mounted.

When the first information portion 76 shown in FIG. 6 is provided at the specification detecting and agitator driving gear 69 in the attached new developer cartridge 30, for example, the CPU 90 detects a short waveform in the pulse width and the pulse interval and thus judges that the maximum image sheet number of the developer cartridge 30 is 3000.

The laser printer 1 thus displays a "toner empty" warning message on the operation panel (not shown) or the like immediately before the number of image formation sheets actually detected by the sheet ejection sensor 60 exceeds 3000 after the new developer cartridge 30 is mounted.

On the other hand, where the developer cartridges 30 are once removed from the main body casing 2 after the mounting of the new developer cartridges 30 and mounted to the main body casing 2 again, for example, for recovery from sheet jam, the new/used cartridge detecting gear 70 keeps a stopped state at a position where the non-toothed portion 83 is opposed to gear teeth 74 of the specification detecting and agitator driving gear 69, i.e., a position where the passage portion 85 of the new/used cartridge detecting gear 70 is overlapped with the irradiating position P of the first information portion 76 in the specification detecting and agitator driving gear 69.

Therefore, even if the initial turning operation is performed by the control of the CPU 90 after mounting again, the new/used cartridge detecting gear 70 is not rotatively driven, that is, the new/used cartridge detecting gear 70 is rotatively driven as long as the developer cartridge 30 mounted is new, and that the new/used cartridge detecting gear 70 is not rotatively driven when the developer cartridge 30 mounted is used. Therefore, immediately after the motor 59 is driven, the CPU 90 is alternately inputted with the sensor-on-signal and the sensor-off-signal on the basis of the alternate disposition of light traveling permissible portions 77 and the light traveling blocking portions 78.

The CPU 90 judges that the developer cartridge 30 is used on the basis that the waveform having a predetermined pulse width W and a predetermined pulse interval S on the basis of the sensor-on-signal and sensor-off-signal is recognized immediately after driving of the motor 59.

As a result, the number of sheets actually used for the image formation is not reset, and the CPU 90 continuously compares the number of the sheets actually used for the image formation as counted from the time of the mounting of the new cartridge 30 with the maximum image formation sheet number thereof.

Moreover, when the developer cartridge 30 is mounted in the laser printer 1, the CPU 90 recognizes a waveform that has a determined pulse width W and a determined pulse interval S on the basis of the sensor-on-signal and sensor-off-signal at the end of a predetermined time t as measured from the start of the driving of the motor in case the developer cartridge 30 is new. On the other hand, when the developer cartridge 30 is used, the CPU 90 recognizes a waveform having a predetermined pulse width W and a predetermined pulse interval S on the basis of the sensor-on-signal and sensor-off-signal immediately after the start of the driving of the motor.

The CPU 90 judges that the developer cartridge 30 is mounted in the main body casing 2 on the basis of the recognition of a waveform that has a predetermined pulse width W and a predetermined pulse interval S.

On the other hand, when the developer cartridge 30 is not mounted to the main body casing 2, a waveform having a predetermined pulse width W and a predetermined pulse interval S as mentioned above is not recognized, so that the CPU 90 judges that the developer cartridge 30 is not mounted to the main body casing 2 on the basis of the non-recognition of the waveform.

4. Effects of Detection Mechanism of Developer Cartridge According to First Embodiment As mentioned above, in the laser printer 1, the CPU 90 makes it possible to detect whether or not the developer cartridge 30 is mounted in the main body casing 2, whether the mounted developer cartridge 20 is new or used, and the maximum image formation sheet number of the developer cartridge 30 mounted in the main body casing 2, thereby enhancing the operability of the laser printer 1.

Further, in the laser printer 1, when the developer cartridge 30 is mounted to the main body casing 2, the driving force is inputted from the motor 59 of the main body casing 2 to the specification detecting and agitator driving gear 69 and rotatively drives the specification detecting and agitator driving gear 69. In accordance with the rotative driving, the specification detecting and agitator driving gear 69 provides the detection portion 91 disposed in the main body casing 2 with information corresponding to the maximum image formation sheet number of the developer cartridge 30, on the basis of the alternate disposition of the light traveling permissible portions 77 detected by the detection portion 91 and the light traveling blocking portions 78 not detected by the detection portion 91. When the developer cartridge 30 is new, the new/used cartridge detecting gear 70 restricts transmission of the information corresponding to the maximum image formation sheet number from the specification detecting and agitator driving gear 69 to the detection portion 91 for a predetermined time t as measured from the start of the rotative driving of the specification detecting and agitator driving gear 69, i.e., as measured from the start of the driving of the motor 59.

Consequently, the CPU 90 can detect whether the developer cartridge 30 mounted in the main body casing 2 is new or used based on whether or not the detection light reflected from the light traveling permissible portions 77 is detected according to the restriction of the new/used cartridge detecting gear 70 for the predetermined time t as measured from the start of the driving of the specification detecting and agitator driving gear 69.

In addition, because the light traveling permissible portions 77 and the light traveling blocking portions 78 are alternately disposed corresponding to the maximum image formation sheet number of the developer cartridge 30 in the specification detecting and agitator driving gear 69, the CPU 90 can detect the maximum image formation sheet number of the developer cartridge 30 mounted in the main body casing 2 from the number and interval of the detection light reflected from the light traveling permissible portions 77, i.e, from the length of the waveform of the aforementioned pulse width W and the pulse interval S.

Further, the CPU 90 can judge whether or not the developer cartridge 30 is mounted to the main body casing 2 based on whether or not the detection light reflected from the light traveling permissible portions 77 is detected.

As the result, the CPU 90 can enhance the operability of the laser printer 1 by detecting whether or not the developer cartridge 30 is mounted in the main body casing 2, and whether the developer cartridge 30 mounted to the main body casing 2 is new or used, and by detecting the maximum image formation sheet number of the developer cartridge 30.

More specifically, the CPU 90 can detect whether or not the developer cartridge is mounted in the main body casing 2 by detecting whether or not the detection light emitted from the light emitting portion 92 is reflected at the light traveling permissible portions 77 of the specification detecting and agitator driving gear 69 and received at the light receiving portion 93.

Further, the CPU 90 can detect whether the developer cartridge 30 mounted in the main body casing 2 is new or used based on whether or not the detection light emitted from the light emitting portion 92 is blocked at the light blocking portion 86 in the new/used cartridge detecting gear 70 and not received by the light receiving portion 93 for a predetermined time t as measured from the start of the rotative driving of the specification detecting and agitator driving gear 69, i.e., the start of the driving of the motor 59.

Further, in the specification detecting and agitator driving gear 69, the light traveling permissible portions 77 and the light traveling blocking portions 78 are provided corresponding to the maximum image formation sheet number of the developer cartridge 30, so that the CPU 90 can detect the maximum image formation sheet number of the developer cartridge 30 mounted in the main body casing 2 by the number and interval of the detection light, i.e., the length of the waveform of the aforementioned pulse width W and the pulse interval S.

As the result, the laser printer 1 can easily and reliably detect whether or not the developer cartridge 30 is mounted in the main body casing 2, whether the developer cartridge 30 mounted in the main body casing 2 is new or used, and the maximum image formation sheet number of the developer cartridge 30 mounted in the main body casing 2 on the basis of the presence or absence, the duration, and number and interval of the detection light emitted from the light emitting portion 92 and received at the light receiving portion 93.

Further, the specification detecting and agitator driving gear 69 is rotated by receiving the driving force from the motor 59, and in accordance with the rotation, the light traveling permissible portions 77 and the light traveling blocking portions 78 each reflects or absorbs the detection light in an alternating manner in the first information portion 76. Therefore, the maximum image formation sheet number of the developer cartridge 30 mounted in the main body casing 2 can be easily and reliably detected.

In the case where the developer cartridge 30 is new, the new/used cartridge detecting gear 70 receives the driving force from the motor 59 and is rotated while the light blocking portion 86 blocks the detection light for a predetermined time t as measured from the start of the new/used cartridge detecting gear 70. Then the non-toothed portion 83 stops the rotative driving when the first information portion 76 and the passage portion 85 are overlapped.

On the other hand, when the developer cartridge 30 is used, the new/used cartridge detecting gear 70 cannot be rotated and is kept stopped since the non-toothed portion 83 keeps the first information portion 76 and the passage portion 85 overlapped with each other, thereby the light passage portion 85 allows the detection light to pass therethrough. The new/used cartridge detecting gear 70 can, therefore, easily and reliably detects whether the developer cartridge 30 mounted in the main body casing 2 is new or used.

Alternatively, in the case where the developer cartridge 30 is new, the light blocking portion 86 of the new/used cartridge detecting gear 70 blocks the detection light when the specification detecting and agitator driving gear 69 starts the driving, i.e., the motor 59 starts the driving. In the case where the developer cartridge 30 is used, the light passage portion 85 of the new/used cartridge detecting gear 70 allows the detection light to pass and the detection light to be reflected at the light traveling permissible portions 77 in the first information portion 76 when the new/used cartridge detecting gear 70 starts driving, i.e., the motor 59 starts the driving. Therefore, it can be easily and reliably detected whether or not the developer cartridge 30 is mounted in the main body casing 2.

As the result, with a simplified configuration, it can be easily and reliably detected whether or not the developer cartridge 30 is mounted in the main body casing 2, whether the developer cartridge 30 mounted in the main body casing 2 is new or used, and the maximum image formation sheet number of the developer cartridge 30 mounted in the main body casing 2.

Further, at the detection light passage in the developer cartridge 30, a part of the specification detecting and agitator driving gear 69 and a part of the new/used cartridge detecting gear 70 are overlapped with each other, so that the detection light is allowed to pass only when the light traveling permissible portions 77 in the specification detecting and the agitator driving gear 69 and the light passage portion 85 in the new/used cartridge detecting gear 70 are overlapped. In the cases other than the above, that is, the case when the light blocking portions 78 of the specification detecting and agitator driving gear 69 and the light passage portion 85 of the new/used cartridge detecting gear 70 are overlapped, the case when the light traveling permissible portions 77 of the specification detecting and agitator driving gear 69 and the light blocking portion 86 of the new/used cartridge detecting gear 70 are overlapped, and the case when the light traveling blocking portions 78 of the specification detecting and agitator driving gear 69 and the light blocking portion 86 of the new/used cartridge detecting gear 70 are overlapped, the detection light is reliably blocked. Therefore, the detection with high accuracy is achieved.

In addition, in the developer cartridge 30, the driving system to input the driving force from the motor 59 to the gear mechanism 63 can be simplified because the gear teeth 74 of the specification detecting and agitator driving gear 69 and the gear teeth 82 of the new/used cartridge detecting gear 70 are in meshed relation. Further, the rotative driving of the new/used cartridge detecting gear 70 can be reliably stopped when the non-toothed portion 83 releases the meshing relation between the specification detecting and agitator driving gear 69 and the gear teeth 74.

Further, in this developer cartridge 30, because the light traveling permissible portions 77 and the light traveling blocking portions 78 in the specification detecting and agitator driving gear 69 are radially disposed from the shaft portion 75 to the gear teeth 74, the light traveling permissible portions 77 and the light traveling blocking portions 78 can be easily disposed corresponding to the maximum image formation sheet number of the developer cartridge 30, thus achieving reliable transmission of the information on the basis of the maximum image formation sheet number of the developer cartridge 30.

Moreover, in the developer cartridge 30, because the non-toothed portion 83 is provided at a part of the outer peripheral surface of the new/used cartridge detecting gear 70, and the light passage portion 85 and the light blocking portion 86 is formed at the flange portion 81 that has a larger diameter than the gear portion 80, the light passage portion 85 and the light blocking portion 86 can reliably achieve the transmission or blocking of the detection light.

In the present embodiment, the specification detecting and agitator driving gear 69 continuously rotates as long as the driving force is inputted from the motor 59. Therefore, when the display shows the specification of the developer cartridge 30, the users can advantageously understand the specification at once.

5. Detection Mechanism of Developer Cartridge According to Second Embodiment

Figure 7:
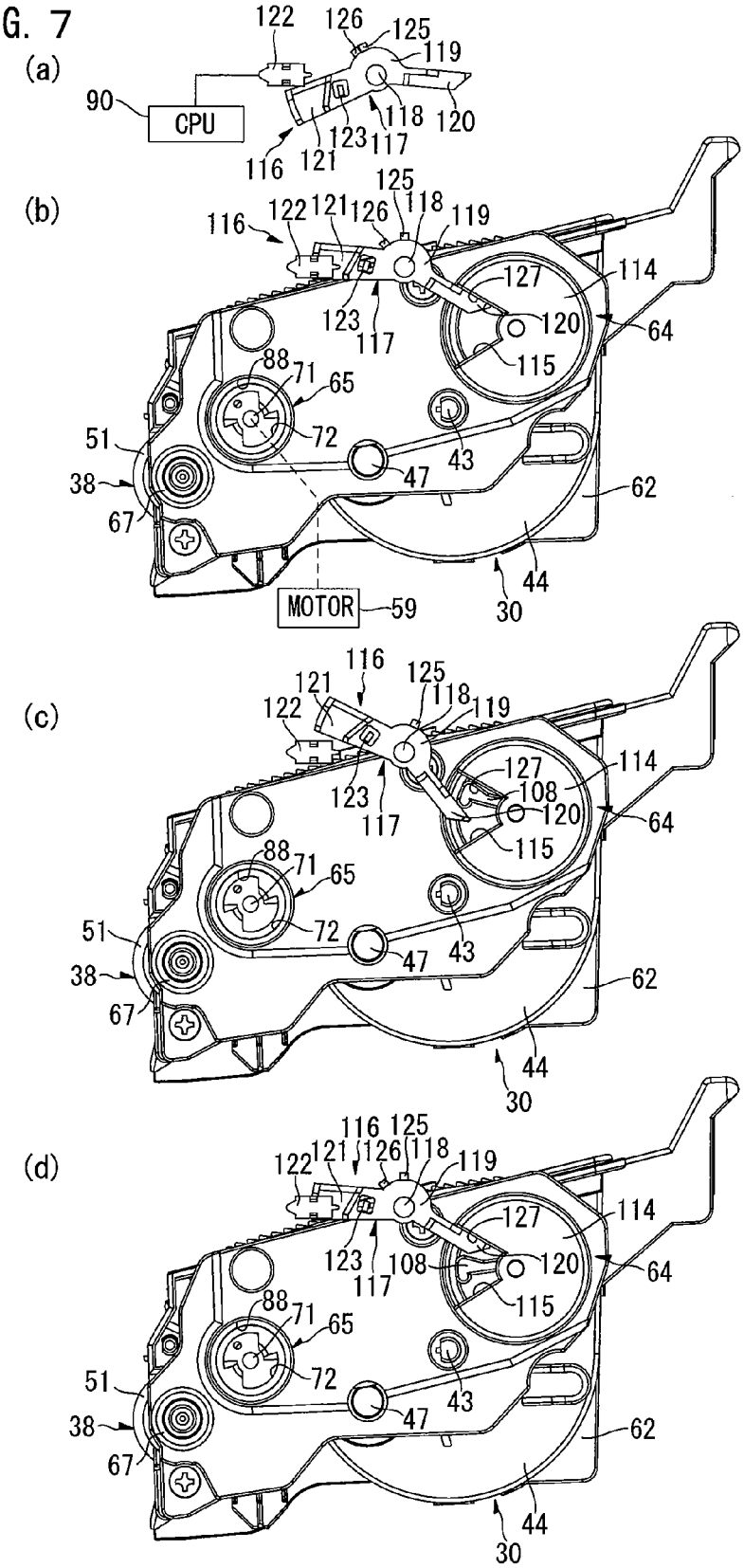
FIGS. 7(*a*) to 7(*d*) are side views for explaining operating states of a developer cartridge (with a gear cover being mounted) according to a second embodiment.
Figure 8:
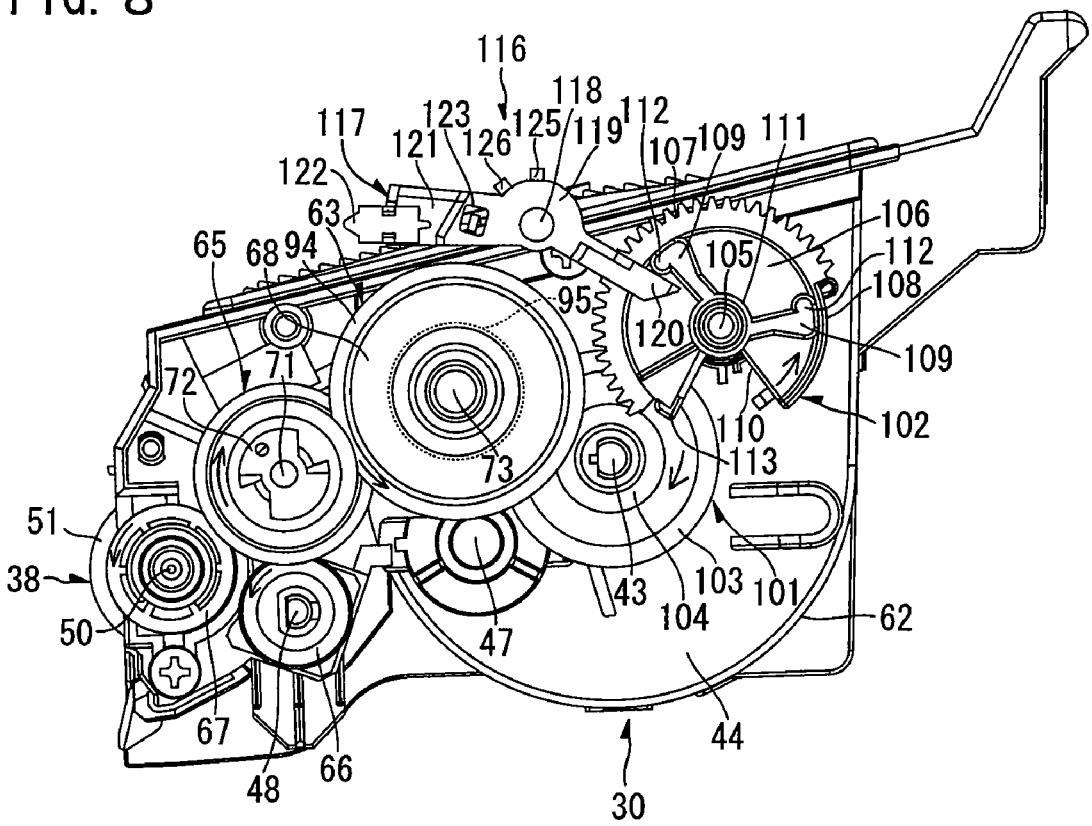
FIG. 8 is a side view illustrating the developer cartridge (with the gear cover being detached) according to the second embodiment.
Figure 9:
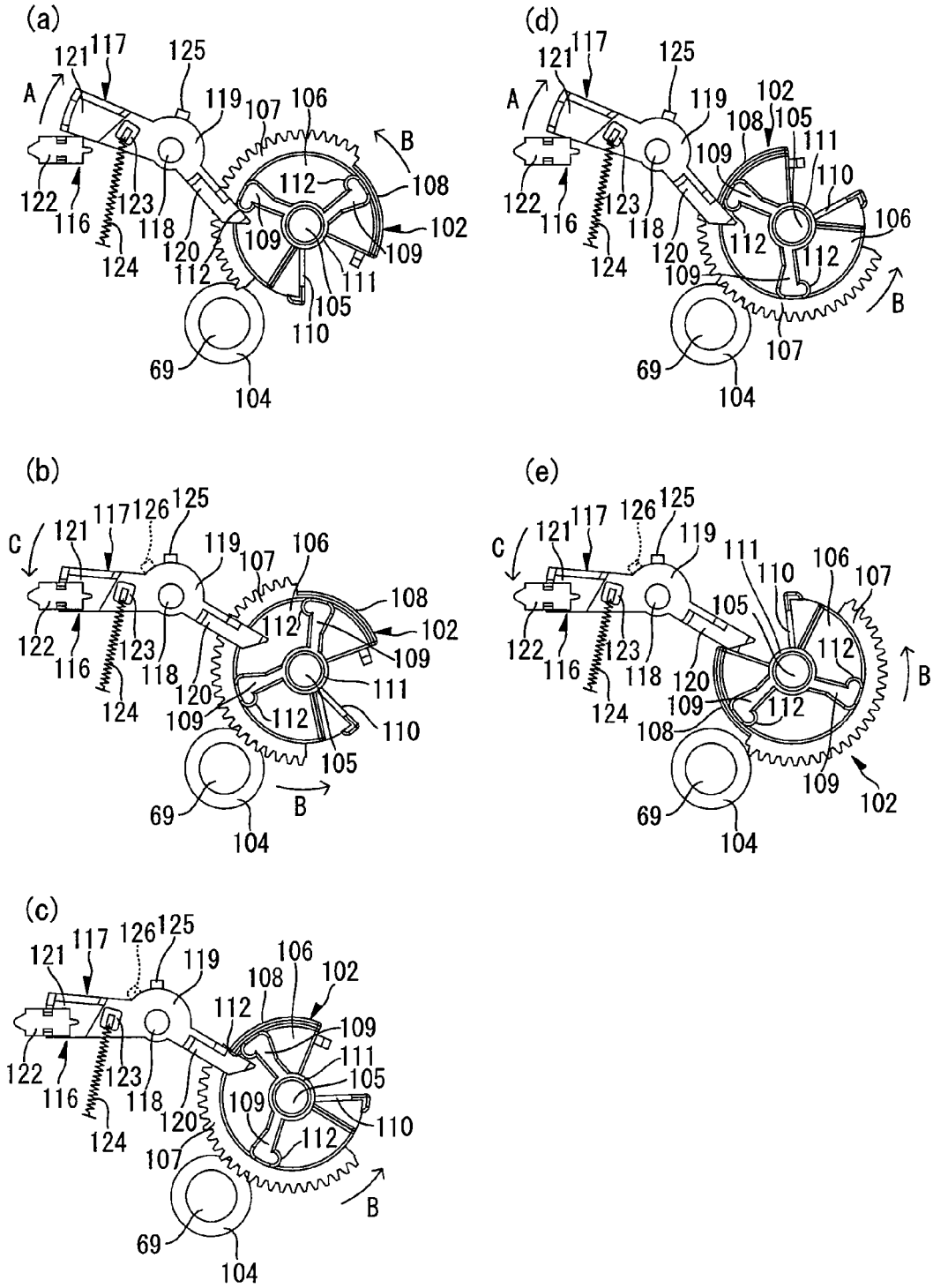
FIGS. 9(*a*) to 9(*e*) are views for explaining the operation of a new cartridge detection mechanism (having two abutment projections).
Figure 10:
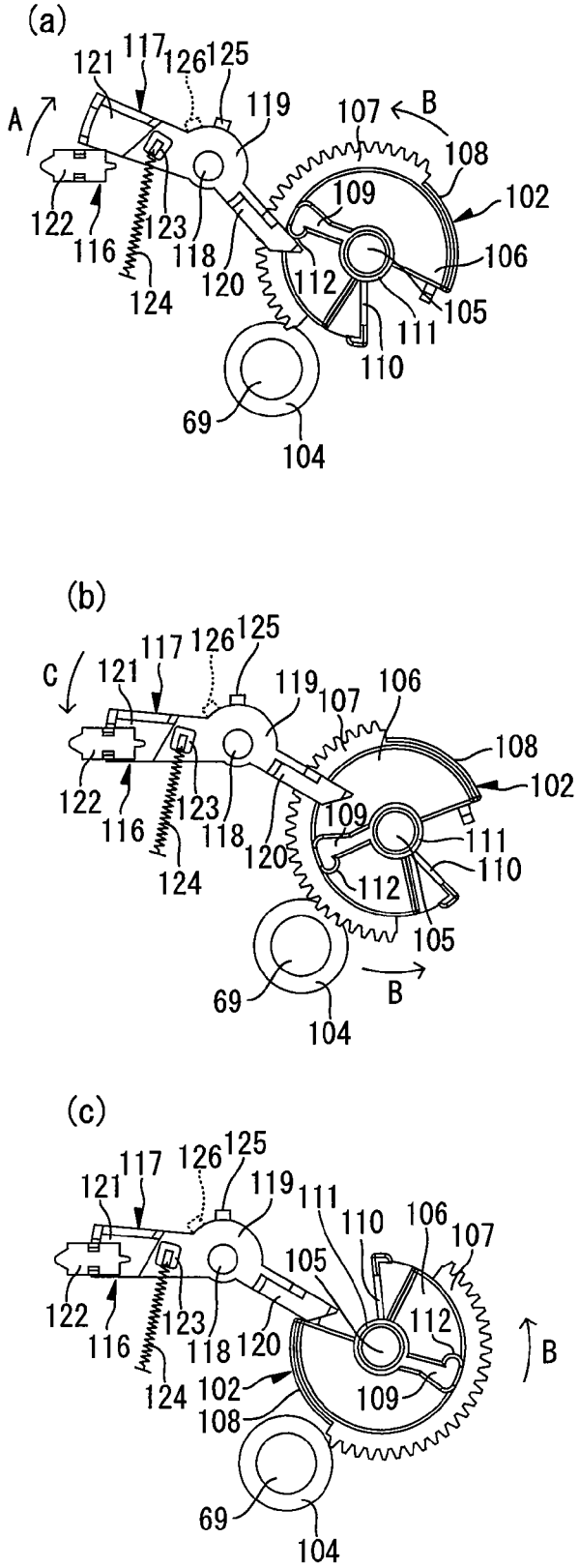
FIGS. 10(*a*) to 10(*c*) are views for explaining the operation of a new cartridge detection mechanism (having a single (narrow) abutment projection) according to the second embodiment.

FIGS. 7(*a*) to 7(*d*) are side views for explaining operating states of a developer cartridge (with a gear cover being mounted) according to a second embodiment. FIG. 8 is a side view illustrating the developer cartridge (with the gear cover being detached) according to the second embodiment. FIGS. 9(*a*) to 9(*e*) are views for explaining an operation of a new cartridge detection mechanism (having two abutment projections) according to the second embodiment. FIG. 10 is a view for explaining the operation of a new cartridge detection mechanism (having a single (narrow) abutment projection) according to the second embodiment.

With reference to FIG. 7 through FIG. 10, the second embodiment of the detection mechanism which detects whether or not the developer cartridge 30 is mounted in the main body casing 2, whether the developer cartridge 30 mounted in the main body casing 2 is new or used, and when the developer cartridge 30 mounted in the main body casing 2 is new, the maximum image formation sheet number of the new developer cartridge 30 is hereinafter described.

In FIG. 7 through FIG. 10, members substantially identical to those members of the first embodiment are given the same reference characters, and accordingly, are not described in detail. The configurations that are different from the first embodiment are described below.

(a) Construction of Developer Cartridge

In FIG. 7 and FIG. 8, this developer cartridge 30, like the developer cartridge 30 according to the first embodiment, is provided with the gear mechanism 63 for rotatably driving the agitator rotating shaft 43 of the agitator 45, the supply roller shaft 48 of the supply roller 37, the developer roller shaft 50 of the developer roller 38, respectively, as shown in FIG. 8, and the gear cover 64 that is a cover member as a detected unit and a pressing unit for covering the gear mechanism 63, as shown in FIG. 7.

As shown in FIG. 8, the gear mechanism 63, like the developer cartridge 30 according to the first embodiment, is provided on the one side wall 44 of the housing 62 of the developer cartridge 30, and includes the input gear 65, the supply roller driving gear 66, the developer roller driving gear 67 and the intermediate gear 68.

The gear mechanism 63 also includes an agitator driving gear 101 as an alternative to the specification detecting and agitator driving gear 69 of the first embodiment, and a detection gear 102 as an alternative to the new/used cartridge detecting gear 70 of the first embodiment, as an information providing unit.

The agitator driving gear 101 is provided obliquely below the front side of the intermediate gear 68 at the shaft end portion of the agitator rotating shaft 43 so that the agitator driving gear 101 unitarily rotates with the shaft end portion. The agitator driving gear 101 is a two-step gear integrally including inner teeth 103 meshed with the inner teeth 95 of the intermediate gear 68 and outer teeth 104 meshed with the detection gear 102.

The detection gear 102 is rotatably supported obliquely above the front side of the agitator driving gear 101 by a detection gear support shaft 105 projecting laterally outward from the one side wall 44.

The detection gear 102 integrally includes a detection gear body 106, gear teeth 107, a non-toothed portion 108 and an abutment projection 109 as a projecting portion.

The detection gear body 106 is formed in a disk shape and provided with a shaft portion 111 at the rotation center thereof and a generally fan-shaped cut away portion 110 extending radially outward from the rotation center. The shaft portion 111 is formed in a cylindrical shape and has the detection gear support shaft 105 inserted therethrough in a relatively rotatable manner.

The gear teeth 107 are partially provided on the outer peripheral surface of the detection gear body 106. That is, the gear teeth 107 are formed at a generally semicircular portion corresponding to the semicircular portion along the way from the one circumferential end to the other circumferential end of the outer peripheral surface of the detection gear body 106. The gear teeth 107 are meshed with the outer teeth 104 of the agitator driving gear 101.

The non-toothed portion 108 is provided on the outer peripheral surface of the gear portion 106 where the gear teeth 107 are not provided. When the non-toothed portion 108 is opposed to the outer teeth 104 of the agitator driving gear 101, the meshed relation between the agitator driving gear 101 and detection gear 102 is released.

The abutment projection 109 is formed as an elongated projection extending radially outward from the shaft portion 111 toward the outer peripheral surface on the outside surface of the detection gear body 106.

The abutment projection 109 has a wider leading end on the side of the outer peripheral surface than the proximal edge of the shaft portion 111, and the leading end is provided with a projection portion 112 projecting in generally L-shape in the rotational direction of the detection gear 102. The leading end of the abutment projection 109 includes the projection portion 112 formed to curve in order to avoid having a sharp edge.

The certain number of the abutment projection 109 is provided so as to correspond with the aforementioned maximum image formation sheet number as a specification of the developer cartridge 30.

More specifically, for example, two abutment projections 109 are provided when the maximum image formation sheet number of the developer cartridge 30 is 6000 as shown in FIG. 9, and one abutment projection 109 is provided when the maximum image formation sheet number of the developer cartridge 30 is 3000 as shown in FIG. 10.

A relative positional relationship between the gear teeth 107 and the non-toothed portion 108 is predetermined so that all of the abutment projections 109 can abut against an abutment claw 120 of the actuator 117 to be described later when the rotation of the detection gear 102 is rotatively driven, i.e., the gear teeth 107 is in meshed relation with the outer teeth 104 of the agitator driving gear 101.

More specifically, in FIG. 9, a leading end of a leading one of the two abutment projections 109 located rotationally upstream of the detection gear 102 is opposed to a middle part (center) of the gear teeth 107 provided along the circumference of the detection gear body 106. Further, a leading end of the trailing abutment projection 109 located rotationally downstream of the detection gear 102 is opposed to an outer portion (non-toothed portion 108) of a rotationally downstream end of the detection gear 102 of the gear teeth 107 provided along the circumference of the detection gear body 106.

As shown in FIG. 8, the detection gear 102 is biased by a coil spring 113 so that the rotationally upstream end of the detection gear 102 of the gear teeth 107 is meshed with the outer teeth 104 of the agitator driving gear 101 in a state where the shaft portion 111 of the detection gear body 106 is inserted in the detection gear support shaft 105 in a relatively rotatable manner.

The coil spring 113 is wound around the detection gear support shaft 105. One end of the coil spring 113 is fixed to the one side wall 44, and the other end of the coil spring 113 is engaged with the cut away portion 110 of the detection gear body 106. Thus, the coil spring 113 constantly biases the detection gear 102 in such a direction that the rotationally upstream end of the detection gear 102 of the gear teeth 107 is opposed to and meshed with the outer teeth 104 of the agitator driving gear 101.

Therefore, the rotationally upstream end of the detection gear 102 of the gear teeth 107 and the outer teeth 104 of the agitator driving gear 101 are meshed with each other from the time when the developer cartridge 30 is new. The biasing force of the coil spring 113 is set larger than that of a coil spring 124 to be later described.

As shown in FIG. 7, the gear cover 64 is mounted on one side wall 44 of the developer cartridge 30 covering the gear mechanism 63. In the rear side of the gear cover 64, a rear opening 88 is formed for exposing the coupling receiving portion 72. Further, a gear cover portion 114 which covers the detection gear 102 is provided in the front side of the gear cover 64.

The detection gear cover portion 114 is bulged laterally outward so as to accommodate the detection gear 102, and a generally fan-shaped detection window 115 spreading vertically is formed on a rear side of the detection gear cover portion 114 for exposing the abutment projection 109 whose leading end is moved circumferentially with the rotation of the detection gear 102.

(b) Construction of Main Body Casing

As shown in FIGS. 7(*a*) to 7(*d*), the main body casing 2 is provided with the CPU 90 as a detecting unit for detecting whether or not the developer cartridge 30 is mounted in the main body casing 2, whether the developer cartridge 30 mounted in the main body casing 2 is new or used, and the maximum image formation sheet number of the new developer cartridge 30 when the developer cartridge 30 mounted in the main body casing 2 is new, and the detection mechanism portion 116 to selectively input the on-signal or the off-signal to the CPU 90.

The detection mechanism portion 116 is provided on the inner wall surface of the one side wall of the main body casing 2, and disposed laterally at one side with respect to the developer cartridge 30 mounted in the main body casing 2.

The detection mechanism portion 116 comprises an actuator 117 as a detection portion and an optical sensor 122.

The actuator 117 is supported swingably by a swing shaft 118 projecting from the inner surface of the one side wall toward laterally inward of the main body casing 2.

The actuator 117 integrally comprises a cylindrically shaped insertion portion 119 into which the swing shaft 118 is inserted, the abutment claw 120 extending forward from the insertion portion 119, and a light blocking portion 121 extending backward from the insertion portion 119.

As shown in FIG. 7(*a*), the abutment claw 120 is disposed in the normal state to extend in generally horizontal direction in a state where the light blocking portion 121 is extended to slightly obliquely lower side.

The light blocking portion 121 has a vertical thickness that can block the detection light emitted from an optical sensor 122.

Further, the light blocking portion 121 has a spring engagement portion 123 at a longitudinally middle portion thereof. One end of the tension springs 124 (See FIGS. 9(*a*) to 9(*e*)) is engaged to the spring engagement portion 123. The tension springs 124 extends downward from the spring engagement portion 123 and the other end is fixed to the inner surface of one side wall (not shown) of the main body casing 2.

The insertion portion 119 is provided with a stopper projection portion 125 projecting radially outward on the upper side of the outer peripheral surface thereof. On the other hand, the main body casing 2 is provided with a stopper abutment portion 126 that can be brought into abutment against the stopper projection portion 125 in proximity to the rear side of the stopper projection portion 125.

As shown in FIG. 9(*a*), the actuator 117 is normally biased in such a manner that the light blocking portion 121 is pulled downward by the tension springs 124, and this biasing force is controlled by abutment of the stopper projection portion 125 against the stopper abutment portion 126, as shown in FIG. 7(*a*).

In the normal state as above, the actuator 117 is kept so that the light blocking portion 121 extends obliquely downward to some extent in the rear side and the abutment claw 120 extends along a generally horizontal direction. In this normal state, the abutment claw 120 of the actuator 117 is disposed at a non-mounting detection position as a second position for detecting that the developer cartridge 30 is not mounted.

As described later in detail, when the developer cartridge 30 is mounted and the press member 127 of the detection gear cover portion 114 is brought into abutment against the abutment claw 120 disposed at the non-mounting detection position, the abutment claw 120 is pressed downward as shown in FIG. 9(*b*), allowing the actuator 117 to cause the light blocking portion 121 thereof to swing upward and the abutment claw 120 thereof to swing downward about the insertion portion 119 against the biasing force applied by the tension springs 124, thereby the abutment claw 120 of the actuator 117 is disposed at a mounting detection position as a first position for detecting that the developer cartridge 30 is mounted. At the same time, the stopper projection portion 125 is spaced apart from the stopper abutment portion 126 by this swing movement.

Further, as described in detail, when the abutment projection 109 of the detection gear 102 is brought into abutment against the abutment claw 120 disposed in the mounting detection position by the rotational driving of the detection gear 102, the abutment claw 120 is pressed further downward as shown in FIG. 9(*c*), allowing the actuator 117 to cause the light blocking portion 121 thereof to swing further upward and the abutment claw 120 thereof to swing further downward about the insertion portion 119 against the biasing force applied by the tension springs 124, thereby the abutment claw 120 of the actuator 117 is disposed at a passing detection position that detects the passing of the abutment projection 109 as a second position that is different from the mounting detection position.

Thereafter, when the abutment projection 109 is brought out of abutment against the abutment claw 120, the light blocking portion 121 swings downward and the abutment claw 120 swings upward about the insertion portion 119 by the biasing force of the tension springs 124 until the abutment claw 120 is brought into abutment against the press member 127, thereby the abutment claw 120 of the actuator 117 is positioned again at the mounting detection position as shown in FIG. 9(*b*).

Although not shown in FIG. 7, the optical sensor 122 has a holder member in generally U-shape as seen from top view with the forward portion thereof opened and a light emitting element and a light receiving element disposed in laterally opposed spaced relation in the holder member. The optical sensor 122 is disposed so that the light blocking portion 121 of the actuator 117 is sandwiched by the holder member.

More specifically, in the optical sensor 122, when the abutment claw 120 of the actuator 117 is positioned at the aforementioned mounting detection position, the detection light emitted from the light emitting element toward the light receiving element is blocked by the light blocking portion 121 (see FIG. 9(*b*), FIG. 9(*c*) and FIG. 9(*e*)).

In addition, when the abutment claw 120 of the actuator 117 is disposed at the aforementioned non-mounting detection position, the light blocking portion 121 is retracted downward from the position between the light emitting element and the light receiving element, and when the abutment claw 120 is positioned at the aforementioned passing detection position, the light blocking portion 121 is retracted upward from the position between the light emitting element and the light receiving element, thereby when the abutment claw 120 is disposed at the non-mounting detection position and the passing detection position, the detection light emitted from the light emitting element toward the light receiving element is received by the light receiving element (see FIG. 9(*a*) and FIG. 9(*d*)).

In the optical sensor 122, an on-signal is inputted to the CPU 90 when the light receiving element receives the detection light and an off-signal is inputted to the CPU 90 when the light receiving element stops receiving the detection light.

6. Operation for Detection Mechanism of Developer Cartridge According to Second Embodiment Next, a method for detecting whether or not the developer cartridge 30 is mounted in the main body casing 2, whether or not the mounted developer cartridge 30 is new, and the maximum image formation sheet number of the new developer cartridge 30 in a state the developer cartridge 30 is mounted in the main body casing 2 is described.

(a) Developer Cartridge Having Two Abutment Projections.

First, the front cover 7 is opened, and the process cartridge 20 in which a new developer cartridge 30 is mounted is mounted from the mounting port 6 to the main body casing 2. Alternatively, the front cover 7 is opened, and the developer cartridge 30 is mounted from the mounting port 6 to the process cartridge 20 that is mounted in the main body casing 2.

Then, as shown in FIG. 7(*a*) and FIG. 7(*b*), the press member 127 of the detection gear cover portion 114 is brought into abutment against the abutment claw 120 of the actuator 117 to press the abutment claw 120 downward, allowing the actuator 117 to cause the light blocking portion 121 to swing upward and the abutment claw 120 to swing downward about the insertion portion 119 against the biasing force applied by the tension springs 124, thereby the abutment claw 120 is moved from the non-mounting detection position to the mounting detection position.

In the optical sensor 122, before the press member 127 of the detection gear cover portion 114 is brought into abutment against the abutment claw 120 of the actuator 117, the abutment claw 120 of the actuator 117 is positioned at the non-mounting detection position, so that on-signal is inputted to the CPU 90. When the abutment claw 120 moves from the non-mounting detection position to the mounting detection position due to the abutment of the press member 127, off-signal is inputted to the CPU 90. The CPU 90 detects that the developer cartridge is mounted, on the basis of the inputted off-signal.

In the case where the developer cartridges 30 are removed from the main body casing 2 after the mounting of the developer cartridges 30, the actuator 117 allows the abutment claw 120 thereof to swing upward and the light blocking portion 121 thereof to swing downward about the insertion portion 119 by the biasing force of the tension springs 124, whereby the abutment claw 120 moves from the mounting detection position to the non-mounting detection position.

Following this movement, the optical sensor 122 inputs the on-signal to the CPU 90. The CPU 90 then judges that the developer cartridge is not mounted, on the basis of the inputted on-signal.

Thus, the CPU 90 detects whether or not the developer cartridge 30 is mounted in the main body casing 2.

The mounting of the developer cartridge 30 to the main body casing 2 causes the coupling insertion portion (not shown) to be inserted into the coupling receiving portion 72 of the input gear 65 of the developer cartridge 30 as described above, allowing the input gear 65, the supply roller driving gear 66, the developer roller driving gear 67, the intermediate gear 68, the agitator driving gear 101, and the detection gear 102 to be driven.

Then, in the laser printer 1, a warm-up operation is started to perform an initial turning operation for rotating the agitator 45 by the control of the CPU 90 as described above.

The trigger for starting the initial turning operation may be the detection signal of the power-on operation or the closing operation of the front cover 7 as described above, or may be a detection signal for detecting the mounting of the developer cartridge on the basis of the off-signal from the optical sensor 122.

In the initial turning operation, the motor 59 provided in the main body casing 2 is driven by the control of CPU 90. The driving force of the motor 59 is inputted from the coupling insertion portion through the coupling receiving portion 72 to the input gear 65 to rotatively drive the input gear 65, thereby rotating the supply roller 37 and the developer roller 38 in the same manner as described above as shown in FIG. 8.

Further, the outer teeth 94 of the intermediate gear 68 meshed with the input gear 65 are rotatively driven, and the inner teeth 95 of the intermediate gear 68 formed integrally with the outer teeth 94 are rotatively driven. When the inner teeth 95 of the intermediate gear 68 is rotatively driven, the inner teeth 103 of the agitator driving gear 101 meshed with the inner teeth 95 of the intermediate gear 68 are rotatively driven, and the agitator 45 is rotated by the rotation of the agitator rotating shaft 43.

When the inner teeth 103 of the agitator driving gear 101 are rotatively driven, the outer teeth 104 of the agitator driving gear 101 formed integrally with the inner teeth 103 are rotatively driven. Then, the detection gear 102 having the gear teeth 107 meshed with the outer teeth 104 of the agitator driving gear 101 is rotatively driven during a distance from the rotationally upstream end to the rotationally downstream end where the gear teeth 107 are formed.

That is, because the detection gear 102 is rotatively driven only when the gear teeth 107 thereof are in a meshed relation with the outer teeth 104 of the agitator driving gear 101, the detection gear 102 is rotatively driven in one direction to make an approximately ½ turn about the detection gear support shaft 105 according to the gear teeth 107 formed at a semicircular portion of the outer peripheral surface of the detection gear body 106, and then stopped. After being stopped, the detection gear 102 is kept in the state since there is a frictional resistance between the detection gear support shaft 105 and the detection gear 102.

In such rotational driving of the detection gear 102, as shown in FIG. 9(*a*), when the rotational driving of the detection gear 102 is started, first, the projection portion 112 of the leading abutment projection 109 is moved along a rotational direction (arrow direction B) of the detection gear 102 in one circumferential direction from the upper side to the lower side and brought into abutment against the abutment claw 120 of the actuator 117 disposed at the mounting detection position from the upper side to the lower side. Then, the actuator 117 allows the abutment claw 120 thereof to swing downward and the light blocking portion 121 thereof to swing upward (arrow direction A) about the insertion portion 119 against the biasing force applied by the tension springs 124, whereby the abutment claw 120 is positioned at the passing detection position. Accordingly, the optical sensor 122 inputs on-signal to the CPU 90.

Thereafter, the projection portion 112 is slid along the abutment claw 120 to further press the abutment claw 120, and then is separated from the abutment claw 120 to pass over the abutment claw 120 as shown in FIG. 9(*b*). The abutment claw 120 is thus brought out of abutment against the projection portion 112. Then, the actuator 117 is swung to move the abutment claw 120 thereof upward and the light blocking portion 121 thereof downward (arrow direction C) about the insertion portion 119 by the biasing force of the tension springs 124, whereby the abutment claw 120 is positioned at the mounting detection position. Accordingly, the optical sensor 122 inputs off-signal to the CPU 90.

The CPU 90 recognizes the aforementioned on-signal and off-signal as the first on-off-signal, and stores the count "1" on the basis of the first on-off-signal.

Thereafter, when the detection gear 102 is further rotationally driven, the projection portion 112 of the trailing abutment projection 109 is brought into abutment against the abutment claw 120 of the actuator 117 at the mounting detection position from the upper side to the lower side as shown in FIG. 9(*c*). The actuator 117 then swings again to move the abutment claw 120 downward and the light blocking portion 121 upward (arrow direction A) about the insertion portion 119 against the biasing force applied by the tension springs 124, whereby the abutment claw 120 is positioned at the passing detection position, as shown in FIG. 9(*d*). Accordingly, the optical sensor 122 inputs on-signal to the CPU 90.

Thereafter, the projection portion 112 is slid along the abutment claw 120 to further press the abutment claw 120, and then separated from abutment claw 120 to pass over the abutment claw 120 as shown in FIG. 9(*e*). The abutment claw 120 is thus brought out of abutment against the projection portion 112. Then, the actuator 117 is swung to move the abutment claw 120 upward and the light blocking portion 121 downward (arrow direction C) about the insertion portion 119 by the biasing force of the tension springs 124, whereby the abutment claw 120 is again positioned at the mounting detection position. Accordingly, the optical sensor 122 inputs off-signal to the CPU 90.

The CPU 90 recognizes the aforementioned on-signal and off-signal as the second on-off-signal, and stores the count "2" on the basis of the second on-off-signal.

Thereafter, when the meshed relation between the gear teeth 107 of the detection gear 102 and the outer teeth 104 of the agitator driving gear 101 is released, and the non-toothed portion 108 of the detection gear 102 is opposed to the outer teeth 104 of the agitator driving gear 101, the rotational driving of the detection gear 102 is stopped, and the warm-up operation including the initial turning operation is terminated.

In the aforementioned initial turning operation, corresponding to the aforementioned number of count, the CPU 90 judges that the developer cartridge 30 is new when the number of the count is not "0" and judges that the developer cartridge 30 is used when the number of the count is "0".

The CPU 90 also stores the table about the maximum image formation sheet numbers corresponding to the aforementioned numbers of count, and, for example, the CPU 90 stores the maximum image formation sheet number of 6000 corresponding to the count "2", and for example, the CPU 90 stores the maximum image formation sheet number of 3000 corresponding to the count "1".

In the above initial turning operation, the CPU 90 detects the count as "2", so that it judges that the mounted developer cartridge 30 is new and at the same time the maximum image formation sheet number thereof is 6000.

The laser printer 1 thus displays a "toner empty" warning message on an operation panel (not shown) or the like immediately before the number of image formation sheets actually detected by the sheet ejection sensor 60 exceeds 6000 after the new developer cartridge 30 is mounted.

On the other hand, where the developer cartridges 30 are once removed from the main body casing 2 after the mounting of the new developer cartridge 30 and mounted again to the main body casing 2, for example, for recovery from sheet jam, the detection gear 102 is kept stopped at the position where the non-toothed portion 108 thereof is being opposed to the outer teeth 104 of the agitator driving gear 101 (see FIG. 9(*e*)).

Therefore, even if the initial turning operation is performed by the control of the CPU 90 after mounting again, the detection gear 102 is not rotatively driven, that is, the detection gear 102 is rotatively driven as long as the developer cartridge 30 is new, and the detection gear 102 is not rotatively driven when the developer cartridge 30 is used. In this case, none of the abutment projections 109 is brought into abutment against the abutment claw 120 of the actuator 117. Therefore, no on-off-signal is inputted from the optical sensor 122 to the CPU 90, so that the CPU 90 detects the count "0" during the initial turning operation and judges that the developer cartridge 30 mounted again is used.

As the result, the actual number of image formation sheets is not reset, but the number of image formation sheets actually used from the time of the mounting of the new developer cartridge 30 and the maximum number of image formation sheet of the developer cartridge 30 are continuously compared.

(b) Developer Cartridge Having Single Abutment Projection

First, the front cover 7 is opened, the process cartridge 20 in which the new developer cartridge 30 is mounted is mounted from the mounting port 6 to the main body casing 2. Alternatively, the front cover 7 is opened, and the new developer cartridge 30 is mounted from the mounting port 6 to the process cartridge 20 that is mounted in the main body casing 2.

The detection gear 102 of the developer cartridge 30 is provided with only one abutment projection 109, as shown in FIGS. 10(*a*) to 10(*c*). This one abutment projection 109 is equivalent to the leading abutment projection 9 of the two abutment projections 109 as described above in FIGS. 9(*a*) to 9(*e*).

As described above in FIG. 7(*a*) and FIG. 7(*b*), the press member 127 of the detection gear cover portion 114 is brought into abutment against the abutment claw 120 of the actuator 117 to move the abutment claw 120 from the non-mounting detection position to the mounting detection position.

Accordingly, the optical sensor 122 inputs the off-signal to the CPU 90. The CPU 90 then judges that the developer cartridge is mounted on the basis of the inputted off-signal.

When the developer cartridges 30 are removed from the main body casing 2 after the mounting of the new developer cartridges 30, the CPU 90 judges that there is no developer cartridge and thereby detects whether or not the developer cartridge 30 is mounted in the main body casing 2, in the same manner as described above.

When the developer cartridge 30 is mounted in the main body casing 2, the warm-up operation is started by the control of CPU 90, and the initial turning operation is performed to rotate the agitator 45, in the same manner as described above.

In the initial turning operation, the rotational driving of the detection gear 102 is first started, then the projection portion 112 of the abutment projection 109 is brought into abutment against the abutment claw 120 of the actuator 117 at the mounting detection position along a rotational direction (arrow direction B) of the detection gear 102 from the upper side to the lower side as shown in FIG. 10(*a*), thereby allowing the actuator 117 to cause the abutment claw 120 to swing downward and the light blocking portion 121 to swing upward (arrow direction A) about the insertion portion 119 against the biasing force applied by the tension springs 124, to position the abutment claw 120 at the passing detection position. Accordingly, the optical sensor 122 inputs the on-signal to the CPU 90.

Thereafter, the projection portion 112 is slid along the abutment claw 120 to further press the abutment claw 120, and then separated from the abutment claw 120 to pass over the abutment claw 120 as shown in FIG. 10(*b*). The abutment claw 120 is thus brought out of abutment against the projection portion 112. Then, the actuator 117 is swung to move the abutment claw 120 upward and the light blocking portion 121 downward (arrow direction C) about the insertion portion 119 by the biasing force of the tension springs 124, and then the abutment claw 120 is positioned at the position for detecting the mounting. Accordingly, the optical sensor 122 inputs the off-signal to the CPU 90.

The CPU 90 recognizes the aforementioned on-signal and off-signal as the first on-off-signal, and stores the count "1" on the basis of the first on-off-signal.

Thereafter, when the meshed relation between the gear teeth 107 of the detection gear 102 and the outer teeth 104 of the agitator driving gear 101 is released, and the non-toothed portion 108 of the detection gear 102 is opposed to the outer teeth 104 of the agitator driving gear 101 as shown in FIG. 10(*c*), the rotational driving of the detection gear 102 is stopped, and the warm-up operation including the initial turning operation is terminated.

In the above initial turning operation, the CPU 90 detects the count "1", so that it judges that the mounted developer cartridge 30 is new and at the same time that the maximum image formation sheet number thereof is 3000.

The laser printer 1 thus displays a "toner empty" warning message on the operation panel (not shown) or the like immediately before the number of image formation sheets actually detected by the sheet ejection sensor 60 exceeds 3000 after the new developer cartridge 30 is mounted.

7. Effects of Detection Mechanism of Developer Cartridge According to Second Embodiment In the laser printer, as described above, the CPU 90 can detect whether or not the developer cartridge 30 is mounted in the main body casing 2, whether the mounted developer cartridge 30 mounted in the main body casing 2 is new or used, and further, the maximum image formation sheet number of the developer cartridge 30, thereby enhancing the operability of the laser printer 1.

Further, in this laser printer 1, when the developer cartridge 30 is mounted in the main body casing 2, the press member 127 of the detection gear cover portion 114 of the developer cartridge 30 presses the abutment claw 120 of the actuator 117 provided in the main body casing 2. Therefore, whether or not the developer cartridge 30 is mounted in the main body casing 2 can be detected based on whether or not the pressing is detected when the developer cartridge 30 is mounted in the main body casing 2.

In addition, after the developer cartridge 30 is mounted to the main body casing 2, the detection gear 102 of the developer cartridge 30 is rotatively driven by receiving the driving force from the motor 59 as long as the developer cartridge 30 is new. In this case, the abutment projection 109 provided in the detection gear 102 passes by the abutment claw 120 so as to contact with and separate from the abutment claw 120. Therefore, whether or not the developer cartridge 30 mounted in the main body casing 2 is new or used can be detected based on whether or not the abutment projection 109 is detected as contacting with and separating from the abutment claw 120.

With the rotational driving of the detection gear 102, the abutment projection 109 contacts with and separates from the abutment claw 120 to inform the abutment claw 120 on the number of count regarding the maximum image formation sheet number of the developer cartridge 30. The maximum image formation sheet number of the developer cartridge 30 mounted in the main body casing 2 thus can be detected.

As the result, the CPU 90 detects whether or not the developer cartridge 30 is mounted in the main body casing 2, and whether the developer cartridge 30 mounted in the main body casing 2 is new or used, and further the maximum image formation sheet number of the developer cartridge 30 mounted in the main body casing 2, thereby enhancing the operability of the laser printer 1.

As described above, according to the movement of the abutment claw 120 of the actuator 117 to the mounting detection position, the non-mounting detection position and the passing detection position and the number of the movement and the interval of the movement, the laser printer 1 can easily and reliably detect whether or not the developer cartridge 30 is mounted in the main body casing 2, whether the developer cartridge 30 mounted in the main body casing 2 is new or used, and the maximum image formation sheet number of the developer cartridge 30 mounted in the main body casing 2.

In the laser printer 1, when the developer cartridge 30 is mounted in the main body casing 2, the press member 127 of the detection gear cover portion 114 of the developer cartridge 30 presses the abutment claw 120 of the actuator 117 provided in the main body casing 2. Whether or not the developer cartridge 30 is mounted in the main body casing 2 can be easily and reliably detected.

Further, the maximum image formation sheet number of the developer cartridge 30 mounted in the main body casing 2 can be easily and reliably detected because the detection gear 102 has the abutment projection 109 that is provided corresponding to the number of the maximum image formation sheet of the developer cartridge 30.

Further, whether the developer cartridge 30 mounted in the main body casing 2 is new or used can be easily and reliably detected because the detection gear 102 is provided with the non-toothed portion 108.

In the detection gear 102, the abutment projection 109 is provided to extend radially between the gear teeth 107 or the non-toothed portion 108 and the shaft portion 111 in the detection gear body 106, so that the abutment projection 109 can be made reliably to contact with the abutment claw 120 in accordance with the rotational driving of the detection gear 102. The CPU 90 can reliably detect the maximum image formation sheet number of the developer cartridge 30.

8. Modification of Second Embodiment

Figure 11:
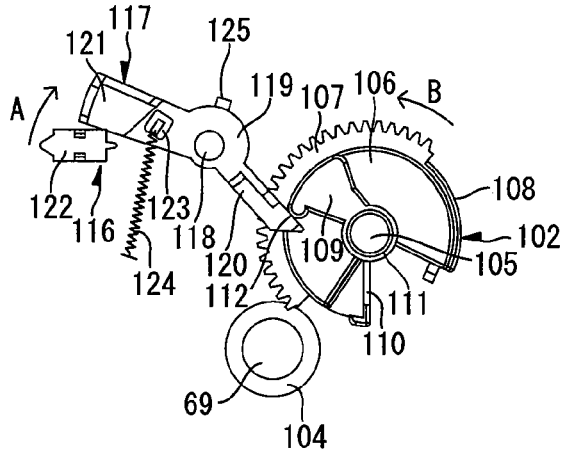
FIGS. 11(*a*) to 11(*c*) are views for explaining the operation of a modified example of the new cartridge detection mechanism (having a single (narrow) abutment projection) according to the second embodiment.
Figure 11:
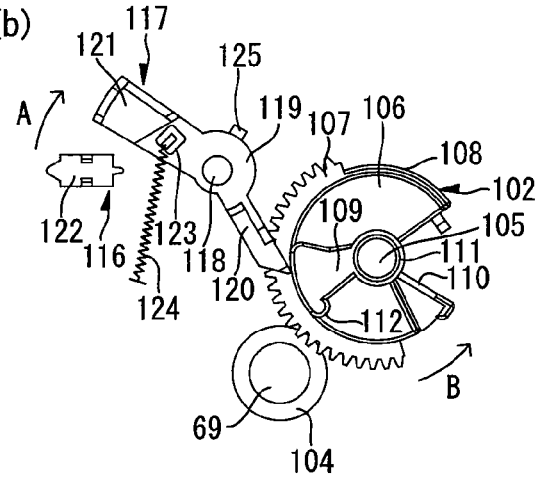
Figure 11:
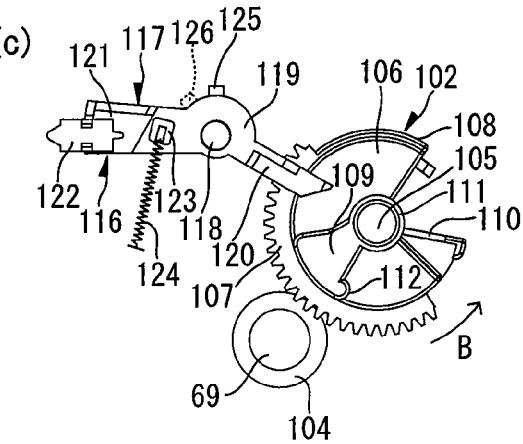

FIGS. 11(*a*) to 11(*c*) are views for explaining the operation of a modified example of the new cartridge detection mechanism (having a single (wide) abutment projection) according to the second embodiment.

In the second embodiment mentioned above, the number of the abutment projection 109 corresponds to the maximum image formation sheet number of the developer cartridge 30. However, the width of the leading end of the abutment projection 109 (the circumferential width of the leading portion including the projection portion 112) may correspond to the maximum image formation sheet number of the developer cartridge 30 as shown in FIGS. 11(*a*) to 11(*c*).

That is, for example, when the abutment projection 109 has a wide leading portion, as shown in FIG. 11, the abutment projection 109 is formed to correspond to the maximum image formation sheet number of 6000, and when the abutment projection 109 has a narrow leading portion, as shown in FIG. 10, the abutment projection 109 is formed to correspond to the maximum image formation sheet number of 3000.

The CPU 90 is adapted to judge the maximum image formation sheet number on the basis of duration of the on-signal inputted from the optical sensor 122 as measured from the start of the driving of the motor 59.

Thus, in FIGS. 10(*a*) to 10(*c*), the on-signal is inputted to the CPU 90 from the optical sensor 122 for a shorter period of time during the initial turning operation corresponding to the time when the projection portion 112 of the abutment projection 109 in the detection gear 102 that is brought into abutment against the abutment claw 120 of the actuator 117 slides with the abutment claw 120 and passes by the abutment claw 120.

On the other hand, in FIGS. 11(*a*) to 11(*c*), the on-signal is inputted to the CPU 90 from the optical sensor 122 for a longer period of time during the initial turning operation corresponding to the time when the projection portion 112 of the abutment projection 109 in the detection gear 102 that is brought into abutment against the abutment claw 120 of the actuator 117 as shown in FIG. 11(*a*) slides with the abutment claw 120 as shown in FIG. 11(*b*) and passes by the abutment claw 120 as shown in FIG. 11(*c*).

The CPU 90 is predetermined to detect the maximum image formation sheet number on the basis of the duration of the on-signal so that, for example, when the duration of on-signal is shorter, the CPU 90 determines that the maximum image formation sheet number is 3000, and when the duration of on-signal period is longer, the CPU 90 determines that the maximum image formation sheet number is 6000.

The width of the leading portion of the abutment projection 109 is thus variably designed, whereby the CPU 90 can determine the maximum image formation sheet number of the developer cartridge 30 without forming a plurality of abutment projections 109.

In the second embodiment described above, the abutment projection 109 is provided on the detection gear 102 as an information providing unit. However, the detection gear 102 may be recessed as long as information on the specification can be provided.

9. Detection Mechanism of Developer Cartridge According to Third Embodiment

Figure 12:
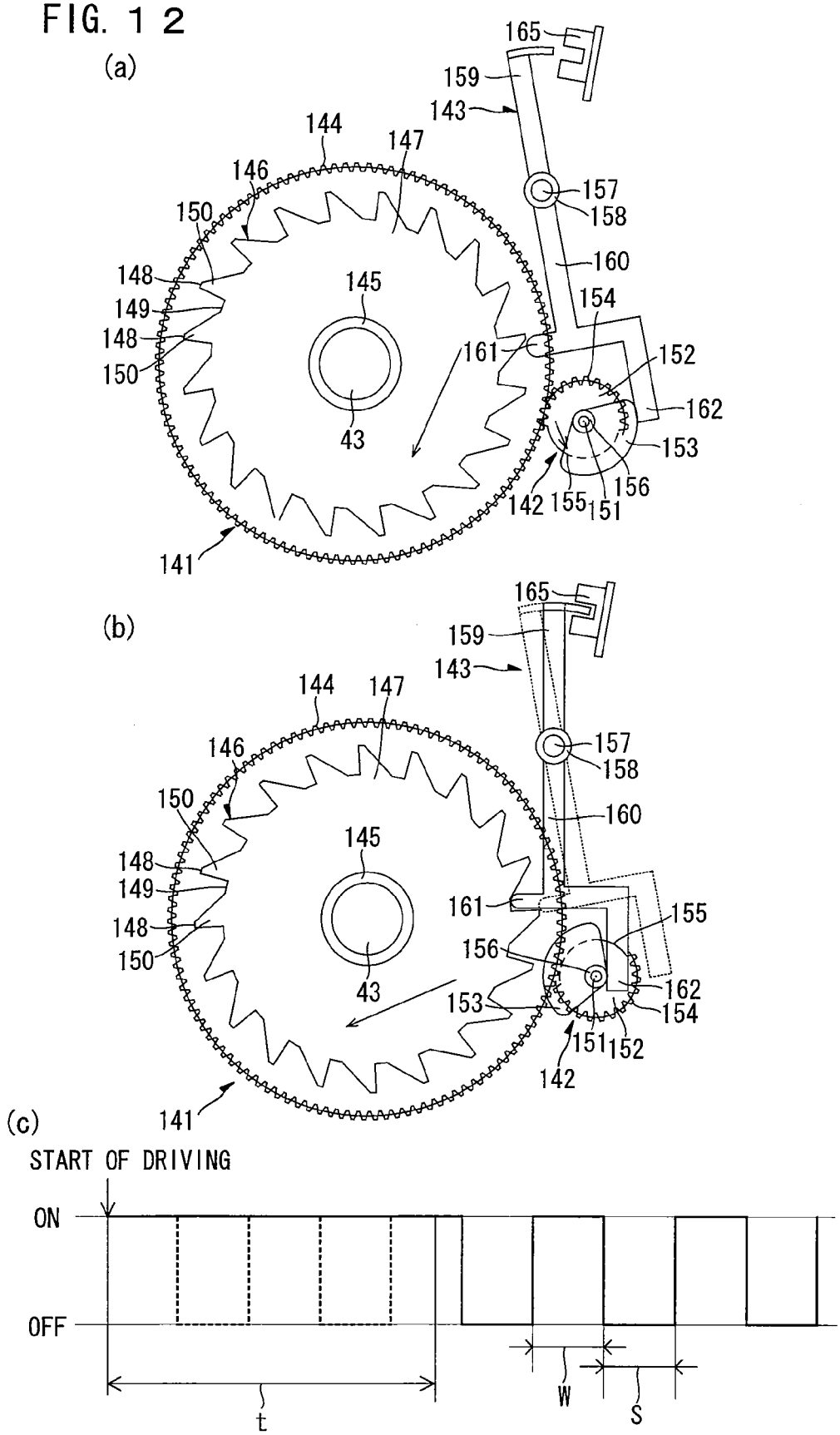
FIG. 12 is a side view illustrating a major portion of a developer cartridge according to a third embodiment of the present invention.

FIGS. 12(*a*) and 12(*b*) are side views illustrating a major portion of a developer cartridge according to a third embodiment.

With reference to FIGS. 12(*a*) to 12(*c*), the detection mechanism according to the third embodiment which detects whether or not the developer cartridge 30 is mounted in the main body casing 2, whether the developer cartridge 30 mounted in the main body casing 2 is new or used, and in the case where the developer cartridge 30 mounted in the main body casing 2 is new, the maximum image formation sheet number of the new developer cartridge 30 is hereinafter described.

FIGS. 12(*a*) and 12(*b*) illustrate only a major portion of the detection mechanism and the construction of the developer cartridge 30 according to the third embodiment is identical to the construction of the developer cartridge 30 according to the aforementioned first embodiment except for the construction shown in FIGS. 12(*a*) and 12(*b*).

In FIGS. 12(*a*) and 12(*b*), the developer cartridge 30 includes a specification detecting and agitator driving gear 141 as an information providing unit and of a construction different from the aforementioned first embodiment, a new/used cartridge detecting gear 142 as an information transmission restricting unit and of a construction different from the aforementioned first embodiment, and a swing arm 143.

The specification detecting and agitator driving gear 141 is provided in the gear mechanism 63 like the first embodiment and, although not shown, is provided on the shaft end portion of the agitator rotating shaft 43 obliquely forward below the intermediate gear 68 so as to rotate together with the shaft end portion of the agitator rotating shaft 43.

The specification detecting and agitator driving gear 141 integrally comprises gear teeth 144 provided on the outer peripheral surface thereof, a shaft portion 145 provided at the rotation center thereof, and a specification detection portion 146 provided between the gear teeth 144 and the shaft portion 145.

The gear teeth 144 are provided along the entire circumference of the outer peripheral surface of the specification detecting and agitator driving gear 141, and, although not shown, meshed with the inner teeth 95 of the intermediate gear 68 and new/used cartridge detecting gear 142.

The shaft portion 145 is provided at the rotation center of the specification detecting and agitator driving gear 141, and has a cylindrical shape. The shaft portion 145 is provided with an agitator rotating shaft 43 inserted therethrough in a relatively non-rotatable manner.

The specification detection portion 146 has a disk shape bulging laterally outward between the gear teeth 144 and the shaft portion 145 of the specification detecting and agitator driving gear 141, and provided with a sawtoothed portion 147 at the outer peripheral thereof.

The sawtoothed portion 147 has a plurality of sawteeth 150 each having a series of crests 148 on the sawteeth 150 and troughs 149 between the sawteeth 150 disposed alternately with each other such that they can provide the optical sensor 165 as a detection portion with information on the basis of the maximum image formation sheet number of the developer cartridge 30.

For example, when the maximum image formation sheet number of the developer cartridge 30 is 6000, the sawtoothed portion 147 is provided with a predetermined number of the sawteeth 150 shown in FIGS. 12(*a*) and 12(*b*), and when the maximum image formation sheet number of the developer cartridge 30 is 3000, the sawtoothed portion 147 is provided with a number of the sawteeth 150 that is less (or more) than the predetermined number shown in FIGS. 12(*a*) and 12(*b*).

The new/used cartridge detecting gear 142 is rotatably supported by the new/used cartridge detecting gear support shaft 151 that projects laterally outward from the one side wall 44 obliquely forward below the specification detecting and agitator driving gear 141.

The new/used cartridge detecting gear 142 has a gear portion 152 and a swing restricting member 153 that rotates together with the gear portion 152.

The gear portion 152 has a diameter smaller than the specification detecting and agitator driving gear 141, and includes a shaft portion 156 at the rotation center thereof, and gear teeth 154 and a non-toothed portion 155 at the outer peripheral surface thereof.

The shaft portion 156 is provided at the rotation center of the gear portion 152 and has a cylindrical shape. The shaft portion 156 has a new/used cartridge detecting gear support shaft 151 inserted therethrough in a relatively rotatable manner.

The gear teeth 154 is provided along the entire circumference of the outer peripheral surface of the gear portion 152 other than the non-toothed portion 155, and meshed with the gear teeth 144 of the specification detecting and agitator driving gear 141.

The gear teeth 154 are partially formed on the outer peripheral surface of the gear portion 152 in such a way that the gear teeth 154 are meshed with the gear teeth 144 of the specification detecting and agitator driving gear 141 only for a predetermined time t during which the swing restricting member 153 is brought into abutment against the swing arm 143 from the start of the driving of the motor 59.

The non-toothed portion 155 is provided at a portion of the outer peripheral surface of the gear portion 152 other than where the gear teeth 154 is provided. When the non-toothed portion 155 is disposed in opposing relation to the gear teeth 144 of the specification detecting and agitator driving gear 141, the meshed relation between the specification detecting and agitator driving gear 141 and the new/used cartridge detecting gear 142 is released.

In the case where the developer cartridge 30 is new, the gear portion 152 is provided in such a way as shown in FIG. 12(*a*) that the upstream end in the rotational direction of the gear portion 152 of the gear teeth 154 meshes with the gear teeth 144 of the specification and detecting agitator driving gear 141.

The swing restricting member 153 is disposed on the shaft portion 156 projecting laterally outward with respect to the gear portion 152.

The swing restricting member 153 has generally fan-shape as seen from side view with a diameter slightly larger than the gear portion 152. The central angle of the swing restricting member 153 is defined so that the outer peripheral surface of the swing restricting member 153 is brought into abutment against the swing arm 143 for a predetermined time t as measured from the start of the driving of the motor 59.

Further, the swing restricting member 153 is provided in a state shown in FIG. 12(*a*) when the developer cartridge 30 is new, that is, disposed in front of the shaft portion 156 so that the upstream end thereof in a rotational direction of the gear portion 152 is brought into abutment against the swing arm 143 to be later described.

The swing arm 143 is rotatably supported by the swing shaft 157 disposed above the new/used cartridge detecting gear 142 and in front of the specification detecting and agitator driving gear 141 and projecting laterally outward from the one side wall 44.

The swing arm 143 integrally comprises a shaft portion 158, a detecting rod 159, and an abutting rod 160.

The shaft portion 158 has a cylindrical shape, and is provided with a swing shaft 157 inserted therethrough in a relatively rotatable manner.

The detecting rod 159 extends upward from the shaft portion 158 and the free end portion thereof is designed so as to crook forward to freely interpose between a light emitting element and a light receiving element of the optical sensor 165 to be later described.

The abutting rod 160 extends downward from the shaft portion 158 in a straight line with the detecting rod 159. The free end portion thereof is generally L-shape as seen from the side view and has a sawtooth abutment portion 161 extending to crook rearward, and a restricting member abutment portion 162 extending to crook forward and then crook further downward.

In the swing arm 143, one end of the spring (not shown) is engaged in a vertically middle portion of the detecting rod 159 and the other end of the spring is engaged with the one side wall 44. The biasing force applied by the spring normally allows the detecting rod 159 to swing forward and the abutting rod 160 to swing backward about the swing shaft 157, i.e., in a clockwise direction as seen from side view.

Thus, when the developer cartridge 30 is new, the swing arm 143 is disposed such that the restricting member abutment portion 162 of the abutting rod 160 is brought into abutment against the upstream end of the swing restricting member 153, and the detecting rod 159 is spaced apart from the optical sensor 165 to be next described, as shown in FIG. 12(*a*).

The main body casing 2 includes the CPU 90 as a detecting unit for detecting whether or not the developer cartridge 30 is mounted in the main body casing 2, whether the developer cartridge 30 mounted in the main body casing 2 is new or used, and the maximum image formation sheet number of the mounted new developer cartridge 30 when the developer cartridge 30 is new, and the optical sensor 165 connected to the CPU 90 as a detection portion.

The optical sensor 165 is provided on the inner surface of the one side wall of the main body casing 2, and includes a holder member that has a generally U-shape as seen from side view and has a rear opening, and, the light emitting element and the light receiving element disposed in opposed relation in the holder member. The optical sensor 165 is designed to freely receive the free end portion of the detecting rod 159.

In the optical sensor 122, when the free end portion of the detecting rod 159 is interposed between the light emitting element and the light receiving element, the free end portion of the detecting rod 159 blocks the detection light emitted from the light emitting element to the light receiving element, thereby inputting the off-signal to the CPU 90 (see FIG. 12(*b*)).

On the other hand, when the free end portion of the detecting rod 159 is separated from the space between the light emitting element and the light receiving element, the detection light emitted from the light emitting element to the light receiving element is received at the light receiving element, thereby inputting the on-signal to the CPU 90 (see FIG. 12(*a*)).

10. Operation of Detection Mechanism of Developer Cartridge According to Third Embodiment Next, a method for judging whether or not the developer cartridge 30 is mounted in the main body casing 2, whether or not the mounted developer cartridge 30 is new, and the maximum image formation sheet number of the developer cartridge 30 after mounting the developer cartridge 30 to the main body casing 2 is described.

When new developer cartridge 30 is mounted in the main body casing 2, the warm-up operation is started by the control of CPU 90, and the initial turning operation is performed to rotate the agitator 45 in the same manner as described in the first embodiment.

When the initial turning operation is performed, the specification detecting and agitator driving gear 141 is rotatively driven, and agitator 45 is rotated by the rotation of the agitator rotating shaft 43.

When the specification detecting and agitator driving gear 141 is rotatively driven, the new/used cartridge detecting gear 142 meshed with the specification detecting and agitator driving gear 141 is rotatively driven during a distance between the rotationally upstream end and the rotationally downstream end in which the gear teeth 154 of the gear portion 152 are formed (gear teeth 154 of the gear portion 152 meshed with the gear teeth 144 of the specification detecting and agitator driving gear 141).

That is, the new/used cartridge detecting gear 142 is rotatively driven for a predetermined time t (see FIG. 12(*c*)) only when the gear teeth 154 are meshed with the gear teeth 144 of the specification detecting and agitator driving gear 141. At the end of the predetermined time t (see FIG. 12(*c*)), the non-toothed portion 155 is opposed to the gear teeth 144 of the specification detecting and agitator driving gear 141 and then the new/used cartridge detecting gear 142 is stopped. As shown in FIG. 12(*b*)), after being stopped, the new/used cartridge detecting gear 142 is kept in the stopped state as there is a frictional resistance with the detection gear support shaft 151.

During such rotational driving of such new/used cartridge detecting gear 152, the restricting member abutment portion 162 of the abutting rod 160 is brought into abutment against the swing restricting member 153 along the rotationally upstream end to the rotationally downstream end of the swing restricting member 153, whereby the free end portion of the detecting rod 159 keeps a separating state from the optical sensor 165. As a result, as shown in FIG. 12(*c*), the on-signal is continuously inputted to the CPU 90 for a predetermined time t as measured from the start of the driving of the motor 59, i.e., from the time when the trigger signal is inputted to the CPU 90.

The CPU 90 determines that the developer cartridge 30 is new on the basis that the on-signal is continuously inputted to the CPU 90 for the predetermined time t, as measured from the start of the driving, i.e., on the basis of the continuous inputting state of the on-signal for duration of the predetermined time t from the start of the driving.

Thereafter, when the non-toothed portion 155 of the new/used cartridge detecting gear 142 is in opposed relation to the gear teeth 154 of the specification detecting and agitator driving gear 141, and the new/used cartridge detecting gear 142 is stopped, as shown in FIG. 12(*b*), the swing restricting member 153 is disposed in a opposed direction to the start of the driving, i.e., at a back side of the shaft portion 156.

Then, the biasing force applied by a spring (not shown) to the swing arm 143 allows the detecting rod 159 to swing forward and the abutting rod 160 to swing backward about the swing shaft 157. As a result, the sawtooth abutment portion 161 of the abutting rod 160 is brought into abutment against the sawtoothed portion 147 of the specification detection portion 146, and, as described next, when the sawtooth abutment portion 161 of the abutting rod 160 is brought into abutment against the troughs 149 between the sawteeth 150, the detecting rod 159 is interposed between the light emitting element and the light receiving element of the optical sensor 165. Accordingly, the optical sensor 165 inputs the off-signal to the CPU 90.

The specification detecting and agitator driving gear 141 is rotatively driven by the driving force from the motor 59, so that when the sawtooth abutment portion 161 that is brought into abutment against the sawtoothed portion 147 is brought into abutment against the crest 148 of each of the sawteeth 150, the sawtooth abutment portion 161 is pressed rearward against the biasing force of a spring (not shown) as indicated by the dotted lines. Accordingly, the swing arm 143 allows the detecting rod 159 thereof to swing backward and the abutting rod 160 thereof to swing forward about the swing shaft 157, and the detecting rod 159 separates from the optical sensor 165, whereby the optical sensor 165 inputs the on-signal to the CPU 90.

On the other hand, when the sawtooth abutment portion 161 that is brought into abutment against the sawtoothed portion 147 is brought into abutment against the trough 149 between the sawteeth 150, the swing arm 143 allows the detecting rod 159 to swing forward and the abutting rod 160 to swing backward about the swing shaft 157 by the biasing force of a spring (not shown) as indicated by the solid line, and the detecting rod 159 is interposed between the light emitting element and the light receiving element of the optical sensor 165, whereby the optical sensor 165 inputs the off-signal to the CPU 90.

Therefore, when the developer cartridge 30 is new, the on-signal is inputted to the CPU 90 for a predetermined time t as measured from the start of the driving of the motor 59, and then the off-signal and the on-signal are inputted alternately to the CPU 90 on the basis of the alternate disposition of the crests 148 of the sawteeth 150 and the troughs 149 between the sawteeth 150, i.e., the number of the sawteeth 150, that corresponds to the maximum image formation sheet number of the developer cartridge 30.

The CPU 90 determines the maximum image formation sheet number of the developer cartridge 30 from the length of the waveform of the pulse width W and the pulse interval S on the basis of the off-signal and the on-signal.

That is, the CPU 90 stores a table about the maximum image formation sheet number that corresponds to the length of the waveform of the pulse width W and the pulse interval S on the basis of the off-signal and the on-signal. For example, the CPU 90 stores the maximum image formation sheet number of 6000 on the basis of the waveform of the pulse width W and the pulse interval S of the sawtoothed portion 147 shown in FIGS. 12(*a*) and 12(*b*), and the CPU 90 stores the maximum image formation sheet number of 3000 on the basis of the longer (or shorter) waveform of the pulse width W and the pulse interval.

In the case where the specification detecting and agitator driving gear 141 of the mounted new developer cartridge 30 is provided with the sawtoothed portion 147 as shown in FIGS. 12(*a*) and 12(*b*), the CPU 90 determines that the maximum image formation sheet number of the developer cartridge 30 is 6000.

Therefore, immediately before the number of sheets actually used for the image formation as counted by a sheet ejection sensor 60 after the mounting of the new developer cartridge 30 exceeds 6000, the CPU 90 displays a "toner empty" warning message on an operation panel (not shown) or the like.

In the case where the specification detecting and agitator driving gear 141 of the mounted new developer cartridge 30 is provided with the larger (or smaller) number of the sawteeth 150 than that of the sawteeth 150 of the sawtoothed portion 147 shown in FIGS. 12(*a*) and 12(*b*), the CPU 90 detects a waveform whose pulse width and pulse interval are both longer (or shorter), and thus determines that the maximum image formation sheet number of the developer cartridge 30 is 3000.

As a result, immediately before the number of sheets actually used for the image formation as counted by a sheet ejection sensor 60 after the mounting of the new developer cartridge 30 exceeds 3000, the CPU 90 displays a "toner empty" warning message on an operation panel (not shown) or the like.

On the other hand, where the developer cartridges 30 are once removed from the main body casing 2 after the mounting of the new developer cartridges 30 and mounted again to the main body casing 2, for example, for recovery from sheet jam, the new/used cartridge detecting gear 142 is kept stopped at a position where the non-toothed portion 155 thereof is opposed to the gear teeth 144 of the specification detecting and agitator driving gear 141, that is, where the swing restricting member 153 of the new/used cartridge detecting gear 142 is disposed in an opposed direction to the start of the driving, i.e., at a back side of the shaft portion 156.

Therefore, even if the initial turning operation is performed by the control of the CPU 90 after mounting again, the new/used cartridge detecting gear 142 is not rotatively driven, that is, the new/used cartridge detecting gear 142 is rotatively driven as long as the developer cartridge 30 is new, and the new/used cartridge detecting gear 142 is not rotatively driven when the developer cartridge 30 is used. In the latter case, the on-signal and the off-signal are alternatively inputted to the CPU 90 without delay on the basis of the alternate disposition of the crests 148 of the sawteeth 150 and the troughs 149 between the sawteeth 150 that corresponds to the maximum image formation sheet number of the developer cartridge 30.

When the CPU 90 detects a waveform having a predetermined pulse width W and a predetermined pulse interval S on the basis of the sensor-on signal and sensor-off signal immediately after the driving of the motor 59, the CPU 90 determines that the developer cartridge 30 is used.

As a result, the actual number of image formation sheets is not reset, but the number of image formation sheets actually used from the time of the mounting of the new developer cartridge 30 and the maximum number of image formation sheets of the developer cartridge 30 are continuously compared.

Further, when the developer cartridge 30 mounted in the laser printer 1 is new, the CPU 90 recognizes the waveform having a predetermined pulse width W and a predetermined pulse interval S on the basis of the sensor-on-signal and sensor-off-signal after a predetermined time t as measured from the start of the driving, as described above. On the other hand, when the developer cartridge 30 mounted in the laser printer 1 is used, the CPU 90 recognizes the waveform having a predetermined pulse width W and a predetermined pulse interval S on the basis of the sensor-on-signal and sensor-off-signal immediately after the start of the driving.

The CPU 90 judges that the developer cartridge 30 is mounted in the main body casing 2 on the basis of such recognition of a waveform having a predetermined pulse width W and a predetermined pulse interval S.

On the other hand, when developer cartridge 30 is not mounted in the main body casing 2, the waveform having a predetermined pulse width W and a predetermined pulse interval S as mentioned above is not recognized, so that the CPU 90 judges that the developer cartridge 30 is not mounted in the main body casing 2 on the basis of such non-recognition of a waveform having a predetermined pulse width W and a predetermined pulse interval S.

11. Effects of Detection Mechanism of Developer Cartridge According to Third Embodiment In the laser printer 1, as described above, the CPU 90 can detect whether or not the developer cartridge 30 is mounted in the main body casing 2, whether the developer cartridge 30 mounted in the main body casing 2 is new or used, and further, the maximum image formation sheet number of the developer cartridge 30 mounted in the main body casing 2, thereby enhancing the operability of the laser printer 1.

In the laser printer 1, when the developer cartridge 30 is mounted in the main body casing 2, the driving force is inputted from the motor 59 of the main body casing 2 to the specification detecting and agitator driving gear 141 and rotatively drives the specification detecting and agitator driving gear 141. In accordance with the rotative driving, the specification detecting and agitator driving gear 141 provides the optical sensor 165 provided at the main body casing 2 with information corresponding to the maximum image formation sheet number of the developer cartridge 30 on the basis of the alternate disposition of the crests 148 of the sawteeth 150 and the troughs 149 between the sawteeth 150. When the developer cartridge 30 is new, the new/used cartridge detecting gear 142 restricts the transmission of the information corresponding to the maximum image formation sheet number from the specification detecting and agitator driving gear 141 to the optical sensor 165 for a predetermined time t as measured from the start of the rotative driving of the specification detecting and agitator driving gear 141, i.e., as measured from the start of the driving of the motor 59.

Consequently, the CPU 90 can detect by the restriction of the new/used cartridge detecting gear 142 whether the developer cartridge 30 mounted in the main body casing 2 is new or the used by whether the off-signal and the on-signal generated by the abutment against the sawtoothed portion 147 of the sawtooth abutment portion 161 is detected or not detected for a predetermined time t as measured from the start of the specification detecting and agitator driving gear 141.

In addition, because the crests 148 of the sawteeth 150 and the troughs 149 between the sawteeth 150 are alternately disposed corresponding to the maximum image formation sheet number of the developer cartridge 30 in the specification detecting and agitator driving gear 141, the CPU 90 can detect the maximum image formation sheet number of the developer cartridge 30 mounted in the main body casing 2 from the number of the detection and the interval of the detection of the off-signal and the on-signal, i.e., the length of the waveform of the pulse width W and the pulse interval S mentioned above.

Further, the CPU 90 can detect whether or not the developer cartridge 30 is mounted in the main body casing 2 by detecting whether or not the off-signal and on-signal is detected.

As a result, the CPU 90 can enhance the operability of the laser printer 1 by detecting whether or not the developer cartridge 30 is mounted in the main body casing 2, and whether the developer cartridge 30 mounted in the main body casing 2 is new or used, and the maximum image formation sheet number of the developer cartridge 30 mounted in the main body casing 2.

In each of the embodiments described above, the developer cartridge 30 and the process frame 27 provided with the photosensitive drum 28 are provided as separate members. However, the developer cartridge according to the present invention may be provided unitarily with the process frame 27.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

an image forming apparatus body;

a developer cartridge attachable to and detachable from the image forming apparatus body;

a detecting unit for detecting whether the developer cartridge is attached to the image forming apparatus body, and at a time when the developer cartridge is attached to the image forming apparatus , 1) detecting whether the developer cartridge is new or used, and 2) detecting a specification of the developer cartridge;

a driving source provided in the image forming apparatus body;

a detection portion provided in the image forming apparatus body and connected to the detecting unit, the detection portion including a light emitting portion for emitting the light and a light receiving portion for receiving the light;

an information providing unit that is provided in the developer cartridge and moved by receiving a driving force from the driving source and provides the detection portion with information corresponding to the specification of the developer cartridge, the information including first information detected b the detection portion provided in the image forming apparatus and second information not detected by the detection portion, the first information and the second information alternately disposed, the information providing unit including a light reflecting portion for allowing light corresponding to the first information to be detected by the detection portion, and a light absorbing portion for preventing light corresponding to the second information from being detected by the detection portion; and an information transmission restricting provided in the developer cartridge for restricting the transmission of the information from the information providing unit to the detection portion for a predetermined time after the information providing unit starts moving responsive to the detecting unit detecting that the developer cartridge is new, wherein the information transmission restricting unit is moved by receiving driving force from the driving source, and includes a light blocking portion for blocking passage of the light for the predetermined time after the information providing unit starts moving, and a light passage portion for allowing passage of the light after the predetermined time.

2. The image forming apparatus according to claim 1, wherein the information providing unit is a first gear that rotates by receiving the driving force from the driving source and includes a first information portion provided with the light reflecting portion and the light absorbing portion, and the information transmission restricting unit is a second gear that rotates by receiving a driving force from the driving source and includes a second information portion provided with the light blocking portion and the light passage portion, and a non-toothed portion for stopping rotation of the second gear when the first information portion and the light passage portion overlap.

3. An image forming apparatus comprising:

an image forming apparatus body;

a developer cartridge attachable to and detachable from the image forming apparatus body;

a detecting unit for detecting whether the developer cartridge is attached to the image forming apparatus body, and at a time when the developer cartridge is attached to the image forming apparatus, 1) detecting whether the developer cartridge is new or used, and 2) detecting a specification of the developer cartridge;

a driving source provided in the image forming apparatus body;

a detection portion provided in the image forming apparatus body and connected to the detecting unit;

a pressing unit provided in the developer cartridge including a pressing member for pressing the detection portion when the developer cartridge is attached to the image forming apparatus body; and an information providing unit provided in the developer cartridge, moved by receiving the driving force from the driving source when the developer cartridge is new, and providing the detection portion with information corresponding to the specification of the developer cartridge by contacting with or separating from the detection portion.

4. The image forming apparatus according to claim 3, wherein the detection portion is swingable, the pressing member presses the detection portion to swing the detection portion to be positioned at a first position when the developer cartridge is attached to the image forming apparatus body, and the information providing unit contacts with and separates from the detection portion so that the detection portion swings between the first position and a second position that is different from the first position.

5. The image forming apparatus according to claim 3, wherein the pressing unit includes a cover member for protecting the information providing unit, and the information providing unit is a gear that rotates by receiving the driving force from the driving source, and includes a projecting portion contacting with the detection portion, in accordance with the rotation of the gear and provided with a number of projections corresponding to the specification of the developer cartridge, and a non-toothed portion for stopping rotational driving of the gear when the projecting portion completely passes the pressing unit.

6. A developer cartridge attachable to and detachable from an image forming apparatus, comprising:

an accommodating chamber for accommodating developing agent; and a detected unit configured to be detected by a detection portion provided in the image forming apparatus when the developer cartridge is attached to the image forming apparatus, and at a time when the developer cartridge is attached to the image forming apparatus, the detected unit configured to allow detection of 1) whether the developer cartridge is new or used, and 2) a specification of the developer cartridge, the detected unit comprising an information providing unit that is configured to be moved by receiving a driving force from a driving source and provides the detection portion with information corresponding to the specification of the developer cartridge, the information including first information detected by the detection portion and second information not detected by the detection portion, the first information and the second information alternately disposed, the information providing unit including a light reflecting portion for allowing light corresponding to the first information to be detected by the detection portion, and a light absorbing portion for preventing light corresponding to the second information from being detected by the detection portion; and an information transmission a restricting unit configured to restrict transmission of the information from the information providing unit for detection by the detection portion for a predetermined time after the information providing unit first gear starts moving when the developer cartridge is new, wherein the information transmission restricting unit is configured to be moved by receiving a driving force, and includes a light blocking portion for blocking passage of the light for the predetermined time after the information providing unit starts moving, and a light passage portion for allowing passage of the light after the predetermined time.

7. The developer cartridge according to claim 6, wherein the information providing unit is a first gear that rotates by receiving the driving force, and includes a first information portion in which the light reflecting portion and the light absorbing portion are disposed, and the information transmission restricting unit is a second gear that rotates by receiving the driving force, and includes a second information portion including the light blocking portion and the light passage portion, and a non-toothed portion for stopping rotation of the second gear when the first information portion and the light passage portion overlap.

8. The developer cartridge according to claim 7, wherein the first gear and the second gear are disposed to partially overlap when the first information portion and the light passage portion overlap.

9. The developer cartridge according to claim 7, wherein the first gear is meshed with the second gear.

10. The developer cartridge according to claim 7, wherein the first gear includes gear teeth provided on an outer peripheral surface thereof and a shaft portion provided at a rotation center thereof, and the first information portion is provided between the gear teeth and the shaft portion, and the light reflecting portion and the light absorbing portion are disposed radially from the shaft portion toward the gear teeth.

11. The developer cartridge according to claim 7, wherein the second gear includes a gear portion having the non-toothed portion at a first part of an outer peripheral surface and gear teeth at a second part of the outer peripheral surface of the gear portion other than the first part of the outer peripheral surface, and a flange portion having a larger diameter than the gear portion, the second information portion is provided in the flange portion, the light passage portion is formed by notching the flange portion, and the light blocking portion is formed by the flange portion other than the light passage portion.

12. A developer cartridge attachable to and detachable from an image forming apparatus, comprising:

an accommodating chamber for accommodating developing agent; and a detected unit configured to be detected by a detection portion provided in the image forming apparatus when the developer cartridge is attached to the image forming apparatus, and at a time when the developer cartridge is attached to the image forming apparatus, the detected unit configured to allow detection of 1) whether the developer cartridge is new or used, and 2) a specification of the developer cartridge, the detected unit comprising:

a pressing unit including a pressing member for pressing a detection portion provided in the image forming apparatus when the developer cartridge is attached to the image forming apparatus; and an information providing unit, which at a time when the developer cartridge is attached to the image forming apparatus, is moved by receiving a driving force when the developer cartridge is new, and contacts with and separates from the detection portion to provide the detection portion with information corresponding to the specification of the developer cartridge.

13. The developer cartridge according to claim 12, wherein the pressing member presses the detection portion to swing the detection portion to be disposed at a first position when the developer cartridge is attached to the image forming apparatus, and the information providing unit contacts with and separates from the detection portion so that the detection portion is allowed to swing between the first position and a second position that is different from the first position.

14. The developer cartridge according to claim 12, wherein the pressing unit is a cover member for protecting the information providing unit, and the information providing unit is a gear that rotates by receiving the driving force, and includes a projecting portion provided with a number of projections corresponding to the specification of the developer cartridge and contacting the detection portion in accordance with rotation of the gear, and a non-toothed portion for stopping rotation of the gear when the projecting portion completely passes the pressing unit.

15. The developer cartridge according to claim 14, wherein the non-toothed portion is provided at a first part of an outer peripheral surface of the gear, the gear includes gear teeth provided on a second part of the outer peripheral surface other than the first part of the outer peripheral surface, and a shaft portion provided at a rotation center thereof, and the projecting portion is provided so as to extend radially along the gear between the gear teeth or the non-toothed portion and the shaft portion.

* * * * *

UNITED STATES PATENT AND TRADEMARK OFFICE

CERTIFICATE OF CORRECTION

PATENT NO. : 7,574,148 B2
APPLICATION NO. : 11/565174
DATED : August 11, 2009
INVENTOR(S) : Hiroshi Igarashi et al.

It is certified that error appears in the above-identified patent and that said Letters Patent is hereby corrected as shown below:

In Column 37, Claim 1, Line 47:
Please delete "b" and insert --by--

In Column 37, Claim 1, Line 58:
Please insert --unit-- in between "restricting" and "provided"

In Column 39, Claim 6, Line 28:
Please delete the word "a"

Signed and Sealed this

Fifth Day of January, 2010

David J. Kappos

David J. Kappos
*Director of the United States Patent and Trademark Office*